US008539631B2

(12) United States Patent
Catalfamo et al.

(10) Patent No.: US 8,539,631 B2
(45) Date of Patent: Sep. 24, 2013

(54) ROLLER FOR PROVIDING BENEFITS TO FABRIC

(75) Inventors: Vincenzo Catalfamo, Cincinnati, OH (US); Jeffrey Donald Painter, Loveland, OH (US); Zaiyou Liu, West Chester, OH (US); George Kavin Morgan, III, Hamilton, OH (US); Trace Wendell de Guzman Trajano, Mason, OH (US); Melissa Jane Wene, Lebanon, OH (US); Cynthia Maria Bedell, Cincinnati, OH (US); Hirotaka Uchiyama, Loveland, OH (US); Toan Trinh, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 2457 days.

(21) Appl. No.: 11/177,657

(22) Filed: Jul. 8, 2005

(65) Prior Publication Data

US 2006/0005333 A1 Jan. 12, 2006

Related U.S. Application Data

(60) Provisional application No. 60/586,496, filed on Jul. 9, 2004, provisional application No. 60/587,561, filed on Jul. 12, 2004.

(51) Int. Cl.
*A47L 25/08* (2006.01)
*B32B 33/00* (2006.01)

(52) U.S. Cl.
USPC ..... 15/104.002; 428/41.8

(58) Field of Classification Search
USPC ..... 15/104.002; 428/41.8
See application file for complete search history.

(56) References Cited

U.S. PATENT DOCUMENTS

| | | | |
|---|---|---|---|
| 4,361,923 | A | 12/1982 | McKay |
| 4,399,579 | A | 8/1983 | McKay |
| 4,422,201 | A | 12/1983 | McKay |
| 4,557,011 | A | 12/1985 | Sartori |
| 4,570,280 | A | 2/1986 | Roth |
| 4,575,890 | A | 3/1986 | Hidle |
| 4,713,274 | A | 12/1987 | Minor |
| 4,727,616 | A | 3/1988 | Kucera |
| 4,811,444 | A | 3/1989 | Hamblin |
| 4,820,558 | A | 4/1989 | Sundberg |

(Continued)

FOREIGN PATENT DOCUMENTS

| | | |
|---|---|---|
| EP | 0 966 915 A1 | 12/1999 |
| FR | 2 692 132 | 12/1993 |

(Continued)

OTHER PUBLICATIONS

U.S. Appl. No. 29/221,010, filed Jan. 10, 2005, Catalfamo, et al.

(Continued)

*Primary Examiner* — David B Thomas
(74) *Attorney, Agent, or Firm* — James F. McBride; Melissa G. Krasovec

(57) ABSTRACT

Roller for providing benefits to fabric. The present invention relates to utilizing one or more benefit agents in conjunction with a hand-held roller in order to provide one or more benefits to fabrics. The present invention also relates to a method for applying one or more benefit agents to the roller.

9 Claims, 1 Drawing Sheet

(56) References Cited

U.S. PATENT DOCUMENTS

| | | | | |
|---|---|---|---|---|
| 4,887,858 | A | 12/1989 | Gazzarrini | |
| 4,905,337 | A | 3/1990 | McKay | |
| 4,920,662 | A | 5/1990 | Seeburger | |
| 4,979,257 | A | 12/1990 | Heneveld | |
| 4,990,192 | A | 2/1991 | Pallone et al. | |
| 5,027,465 | A | 7/1991 | McKay | |
| 5,080,463 | A * | 1/1992 | Faykish et al. | 359/536 |
| 5,089,160 | A | 2/1992 | Pallone et al. | |
| 5,148,571 | A | 9/1992 | Brazis et al. | |
| 5,153,254 | A | 10/1992 | Chen | |
| 5,230,303 | A | 7/1993 | Rubino | |
| 5,234,798 | A * | 8/1993 | Heninger et al. | 430/340 |
| 5,333,341 | A | 8/1994 | Heneveld | |
| 5,388,300 | A | 2/1995 | Hickey | |
| 5,533,223 | A | 7/1996 | Ho | |
| 5,548,861 | A | 8/1996 | Hukuba | |
| 5,553,344 | A | 9/1996 | Rosenkrantz | |
| 5,569,521 | A | 10/1996 | Francoeur et al. | |
| 5,575,031 | A | 11/1996 | Chai | |
| 5,616,387 | A | 4/1997 | Augst et al. | |
| 5,650,215 | A | 7/1997 | Mazurek et al. | |
| 5,742,969 | A | 4/1998 | Pociejewski et al. | |
| 5,763,038 | A | 6/1998 | Wood | |
| 5,878,457 | A | 3/1999 | Cox et al. | |
| 5,894,623 | A | 4/1999 | Thill | |
| 5,922,427 | A | 7/1999 | King | |
| 5,940,921 | A | 8/1999 | Wood et al. | |
| 6,014,788 | A | 1/2000 | Jaffri | |
| 6,024,970 | A | 2/2000 | Woodard | |
| 6,055,695 | A | 5/2000 | McKay, Jr. | |
| 6,127,014 | A | 10/2000 | McKay, Jr. | |
| 6,197,397 | B1 | 3/2001 | Sher et al. | |
| 6,343,397 | B1 | 2/2002 | Odagiri | |
| 6,425,136 | B1 | 7/2002 | Schlamp et al. | |
| 6,427,278 | B1 | 8/2002 | McKay, Jr. | |
| 6,449,794 | B1 | 9/2002 | Jaffri | |
| 6,460,191 | B1 | 10/2002 | Lorkovic | |
| 6,469,118 | B1 * | 10/2002 | Su | 526/318.44 |
| 6,576,323 | B2 | 6/2003 | Wise et al. | |
| 6,586,384 | B2 * | 7/2003 | Van Der Logt et al. | 510/392 |
| 6,688,464 | B2 | 2/2004 | Jessen et al. | |
| 6,865,765 | B2 * | 3/2005 | Aalbers | 15/104.002 |
| 7,234,188 | B1 * | 6/2007 | McKay | 15/104.002 |
| 2001/0034314 | A1 * | 10/2001 | Hemmington et al. | 510/305 |
| 2001/0053644 | A1 * | 12/2001 | Doniger | 442/59 |
| 2002/0088070 | A1 | 7/2002 | Cho | |
| 2002/0124335 | A1 | 9/2002 | Franko | |
| 2002/0144367 | A1 | 10/2002 | McKay, Jr. | |
| 2003/0039822 | A1 | 2/2003 | Aalbers | |
| 2003/0039824 | A1 | 2/2003 | Aalbers | |
| 2003/0088928 | A1 | 5/2003 | Shizuno et al. | |
| 2003/0096074 | A1 | 5/2003 | Kim | |
| 2003/0135941 | A1 | 7/2003 | Vosbikian | |
| 2003/0154569 | A1 | 8/2003 | McKay | |
| 2003/0165650 | A1 | 9/2003 | Hirota et al. | |
| 2003/0167583 | A1 | 9/2003 | Shizuno et al. | |
| 2003/0209564 | A1 | 11/2003 | McKay | |
| 2003/0209565 | A1 | 11/2003 | McKay | |
| 2003/0229958 | A1 | 12/2003 | Thompson et al. | |
| 2004/0007252 | A1 | 1/2004 | Namikawa et al. | |
| 2004/0052570 | A1 | 3/2004 | McKay | |
| 2004/0058116 | A1 | 3/2004 | Sano et al. | |
| 2004/0161450 | A1 * | 8/2004 | Buder | 424/443 |
| 2006/0009337 | A1 | 1/2006 | Smith | |
| 2006/0030745 | A1 * | 2/2006 | Roselle et al. | 585/445 |
| 2008/0187596 | A1 * | 8/2008 | Dihora et al. | 424/490 |
| 2008/0263794 | A1 * | 10/2008 | Sivik et al. | 15/104.002 |

FOREIGN PATENT DOCUMENTS

| | | | |
|---|---|---|---|
| GB | 2 204 228 | A | 11/1988 |
| GB | 2 379 382 | A | 3/2003 |
| IT | 00 238 791 | | 12/1995 |
| WO | WO 83/01734 | | 5/1983 |
| WO | WO 01/081011 | A1 | 11/2001 |
| WO | WO 02/083834 | A1 | 10/2002 |

OTHER PUBLICATIONS

U.S. Appl. No. 29/221,011, filed Jan. 10, 2005, Catalfamo, et al.
U.S. Appl. No. 29/221,040, Jan. 10, 2005, Smith, et al.
International Search Report mailed Nov. 16, 2005, 4 pages.

* cited by examiner

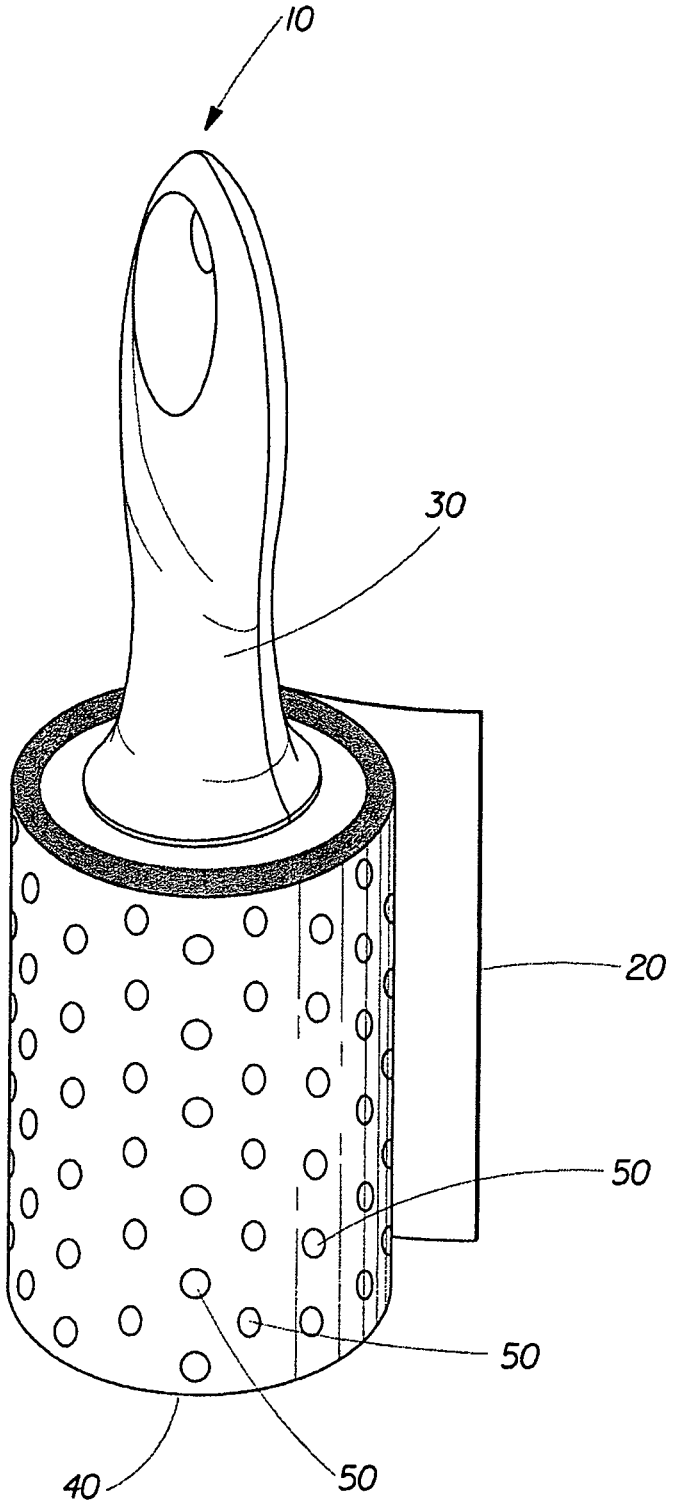
10
30
20
50
50
40
50

ROLLER FOR PROVIDING BENEFITS TO FABRIC

CROSS REFERENCE TO RELATED APPLICATIONS

This application claims the benefit of U.S. Provisional Application Ser. No. 60/586,496 filed on Jul. 9, 2004 and U.S. Provisional Application Ser. No. 60/587,561 filed on Jul. 12, 2004.

FIELD

The present invention relates to hand-held rollers which can provide benefits to fabric.

BACKGROUND

One difficulty associated with hand-held rollers utilized to provide benefits to fabric is the ability of the roller to adequately transfer the benefit between the roller and the fabric. For example, when transferring a benefit agent between the roller and the fabric, a non-limiting example of which is a perfume, it is desirable that the perfume scent contained on the roller be evident to the user. It is also desirable that the perfume scent be evident on the fabric upon transfer of the perfume from the roller to the fabric. Furthermore, it is desirable that the scent be evident on the fabric after the initial transfer from the roller to the fabric. The present invention addresses this by providing a roller capable of adequately transferring one or more benefit agents between the roller and fabric. This and other features, aspects, advantages, and variations of the present invention will become evident to those skilled in the art from a reading of the present disclosure with the appended claims and are covered within the scope of the claims.

SUMMARY OF THE INVENTION

The present invention relates to a hand-held roller for providing benefits to fabrics. In one embodiment the hand-held roller comprises:

a) a substrate formed into a roll, the substrate having a first side and a second side opposite the first side;
b) an adhesive on the first side of the substrate; and
c) a benefit agent on the first side of said substrate the benefit agent present on the substrate in an amount of about 0.1 gram/m$^2$ to about 15 grams/m$^2$ wherein the benefit agent comprises a perfume composition. The perfume composition comprises at least about 25% by weight of blooming perfume ingredients and at least about 25% by weight of substantive perfume ingredients.

In another embodiment, the hand-held roller comprises:

a) a substrate formed into a roll including a first side facing outwardly and a second side opposite the first side facing inwardly toward the center of the roll;
b) an adhesive on the first side of the substrate;
c) a barrier agent on the first side of the substrate wherein the barrier agent is flexographically applied to the first side of the substrate in discrete locations;
d) a benefit agent wherein the benefit agent is flexographically applied to the barrier agent on the first side of the substrate; and
e) an optional release coating on the second side of the substrate.

In yet another embodiment, the hand-held roller comprises:

a substrate formed into a roll, the substrate comprised of co-extruded plastic film wherein the co-extruded plastic film is comprised of at least two sides wherein one side of the co-extruded plastic film includes a benefit agent.

The present invention also relates to a method for making a roller for transferring benefits to a fabric. The method comprises:

a) providing a substrate having a first side and a second side opposite the first side;
b) applying an adhesive to the first side of the substrate;
c) applying a benefit agent to the first side of the substrate, the second side of the substrate, or a combination thereof;
d) forming a roll comprised of a plurality of wraps of the substrate whereby the first side of the substrate faces outwardly and the second side of the substrate faces inwardly toward the center of the roller.

BRIEF DESCRIPTION OF THE DRAWINGS

FIG. 1 is a perspective view of an embodiment of a roller article made in accordance with the present invention.

DETAILED DESCRIPTION

Reference will now be made in detail to various embodiments of the present invention, examples of which are illustrated in the accompanying drawings wherein like numerals indicate the same elements throughout the views. All percentages, ratios and proportions herein are on a weight basis unless otherwise indicated.

Except as otherwise noted, all amounts including quantities, percentages, portions, and proportions, are understood to be modified by the word "about", and amounts are not intended to indicate significant digits.

Except as otherwise noted, the articles "a", "an", and "the" mean "one or more".

As used herein, "comprising" means that other steps and other ingredients which do not affect the end result can be added. This term encompasses the terms "consisting of" and "consisting essentially of". The compositions and methods/processes of the present invention can comprise, consist of, and consist essentially of the essential elements and limitations of the invention described herein, as well as any of the additional or optional ingredients, components, steps, or limitations described herein.

As used herein, "benefit agent" refers to a material or mixture of materials which provide benefits to fabrics. Non-limiting examples of benefit agents include perfume, softening agents, crispening agents, water/stain repellents, refreshing agents, anti-static agents, anti-microbial agents, disinfecting agents, durable press agents, wrinkle resistant agents, wrinkle release agents, odor resistance agents, malodor control agents, abrasion resistance agents, solvents, insect/pet repellents, wetting agents, UV protection agents, skin/fabric conditioning agents, skin/fabric nurturing agents, color protection agents, silicone, preservatives, bleach and/or bleach precursors, cleaning agents, fabric shrinkage-reducing agents, organic solvents, and combinations thereof.

As used herein the term "fabric" encompasses articles of fabric including but not limited to: clothing, linen, draperies, upholstery, clothing accessories, leather, floor coverings, and the like. The term also encompasses other items made in whole or in part of fabric, such as tote bags, furniture covers, tarpaulins, shoes, and the like.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Roller

The hand-held roller of the present invention provides for the transfer of benefits between the roller and a fabric. The roller comprises a substrate. The substrate may be formed into a roll. The substrate may be comprised of a plurality of wraps, each substrate wrap having a first side which faces outwardly toward a user and a second side facing inwardly away from the user (i.e.; facing toward the center of the roll). Each wrap of substrate may be separated from the adjacent wrap via a separation. Non-limiting examples of suitable separations include slits, perforations, and the like. If desired, the plurality of substrate wraps may be wrapped around a core. The core may be comprised of materials familiar to those of ordinary skill in the art including cellulosic and/or non-cellulosic materials, non-limiting examples of which include cardboard, plastic, metal, and the like.

The substrate includes a benefit agent. The benefit agent can be applied to the outwardly facing first side of the substrate, the inwardly facing second side of the substrate, or both sides of the substrate. The benefit agent can be applied to the surface of the substrate, it can be incorporated into the substrate, or a combination thereof. Upon contact of the roller to a surface such as the surface of a fabric, the benefit agent is transferred from the roller to the fabric. In addition to providing a benefit to the fabric, the benefit agent may also provide a benefit to the roller and/or to the area surrounding the roller and/or the area surrounding the fabric.

For example, in one non-limiting embodiment, when a perfume is used as a benefit agent in the roller of the present invention, the perfume may provide scent to the roller. Scent may also be provided to the area surrounding the roller. Additionally, upon contact of the roller to a fabric, scent may be provided to the fabric and the area surrounding the fabric. Furthermore, in one non-limiting embodiment of the present invention, upon contact of the roller to the fabric, a more efficient transfer of the benefit agent from the roller to the fabric occurs thereby allowing for enhanced transfer and retention of the benefit on the fabric.

The substrate also may include an adhesive for providing contaminant removal from a surface a non-limiting example of which is the surface of a fabric. When included, the adhesive is most generally applied to the outwardly facing first side of the substrate. A release coating may also be included to effect removal of the individual wraps of the substrate from the roll as well as to help facilitate release of the substrate during the manufacturing process. Typically, the release coating is added to the inwardly facing second side of the substrate.

In some instances it may be desirable to include a barrier agent with the substrate. The barrier agent may be applied to either the outwardly facing first side of the substrate and/or the inwardly facing second side of the substrate. The barrier agent may be applied to the entire substrate or to portions thereof. It may be applied in a continuous, semi-continuous, or discontinuous pattern, or combinations thereof. It may be applied in discrete locations. The barrier agent may be applied to a carrier non-limiting examples of which include particles such as zeolite, starch, and cyclodextrin; polymeric films; woven or non-woven materials which may be cellulosic or non-cellulosic based; and combinations thereof. The carrier comprising the barrier agent may then be applied to the roller substrate. In one non-limiting embodiment, the carrier comprising the barrier agent may be laminated to the substrate. It may be laminated to discrete locations of the substrate. While not wishing to be bound by theory, in some instances it is possible that contact of the adhesive with the benefit agent on the substrate may reduce the efficacy of the benefit agent. The barrier agent may be used to separate the adhesive and benefit agent so as to help prevent loss in benefit agent efficacy. For instance, in one non-limiting embodiment, where an adhesive is applied to the outwardly facing side of the substrate and a benefit agent such as a perfume is to be applied to the adhesively coated substrate, it may be desirable to apply a barrier agent to all or some part of the areas where the perfume is to be applied so as to minimize contact between the adhesive and the perfume.

Other optional additional components can be included as well with the substrate. One non-limiting example of an optional additional component is a signal which can be used to communicate a condition to a user. For example, a color signal may be used to communicate when the topmost sheet of the roller is fully used so that the user knows when to remove this sheet from the roll.

It should be noted that any of the materials added to the substrate including but not limited to adhesives, benefit agents, release agents, barrier agents, and/or optional additional components may be applied to the entire substrate or to portions thereof. They may be applied in a continuous, semi-continuous, or discontinuous pattern, or combinations thereof. They may be applied in discrete locations.

A. Substrate

The substrate of the present invention may be any material which can be used to transfer a benefit agent between the roller and the fabric. Non-limiting examples of suitable substrates include cellulosic and non-cellulosic materials including but not limited to paper, polymeric and plastic film materials, non-woven materials, foams, and combinations thereof. Non-limiting examples of suitable polymeric and plastic film materials include: polyolefins such as polypropylene; copolymers of ethylene or propylene; halogenated polymers such as polyvinyl chloride and polyvinylidene chloride; polyesters such as polyethylene terephthalate; polyurethanes; polyvinyly acetate; and vinyl acetate copolymers.

Substrates used with the present invention will typically have a basis weight of between about 25 grams/meter$^2$ to about 150 grams/meter$^2$, or about 50 grams/meter$^2$ to about 100 grams/meter$^2$ and a caliper of between about 0.025 mm to about 0.160 mm or between about 0.060 mm to about 0.130 mm.

While not wishing to be bound by theory it is believed that rollers comprised of a plurality of wraps of a substrate wherein each wrap has at least one smooth side may reduce the number of air channels between the wraps hence reducing the propensity of benefit agents escaping prematurely from interior wraps of the roller. This can be beneficial when utilizing for example a benefit agent which might include components which are easily volatilized such as a perfume. Other non-limiting factors which may help prevent premature escape of the benefit agent(s) from the interior wraps of the roller include: utilizing substrates which tend to have low moisture vapor transmission rates, non-limiting examples of which include olefin-based films such as polypropylene; providing high sheet to sheet adhesion between the wraps of the substrate, which may be accomplished by utilizing a substrate having smooth edges along the sides of the substrate and/or by utilizing considerable winding tensions during the roller wrap manufacturing process; and/or by providing a way to physically "lock-in" the benefit agent one non-limiting example of which is providing a relief along the edges of the substrate via embossing, coating, or the like so as to seal the space between adjacent wraps of the substrate.

The improved contact between the substrate wraps helps prevent this premature escape and thereby helps preserve the benefit within the interior wraps so that the benefit is available when the consumer is ready to utilize that portion of the substrate. One or both sides of the substrate may be embossed or unembossed.

One or both sides of the substrate may be corona treated. Corona treatment refers to an electric arc discharge treatment that may be used in some instances to increase the surface energy of substrates that may otherwise be difficult to wet/coat with coatings, adhesives, inks, and the like. For example, corona treatment may be used to treat hydrophobic films, nonwovens, and foams to make their surface more hydrophilic. While not wishing to be bound by theory, it is believed that the higher surface energy provided by corona treatment will tend to make the substrate more hydrophilic and hence more wettable. Typically, it is desirable that the surface energy of the substrate be higher than the surface tension of the matter being applied to the substrate. Otherwise, if the surface energy of the substrate is lower than the surface tension of the matter being applied to the substrate, then upon application to the substrate the matter will tend to bead-up on the surface of the substrate resulting in minimal wetting/penetration/wicking into the substrate.

One non-limiting example of a suitable substrate for use with the present invention is a polypropylene film comprised of a polypropylene homopolymer. Non-limiting examples of suitable polypropylene films include EXTREL® 366 and EXTREL® 393 available from Tredegar Film Products of Richmond, Va. Suitable polypropylene films are also available from Clopay Plastic Products of Cincinnati, Ohio and International Graphic Films Incorporated of Hudson, Ohio.

B. Benefit Agent

The present invention may include one or more benefit agents. The benefit agent may be present on the substrate in an amount of about 0.1 grams/$m^2$ to about 15 grams/$m^2$, or about 0.5 grams/$m^2$ to about 5 grams/$m^2$, or about 1 grams/$m^2$ to about 3 grams/$m^2$. The benefit agent may be comprised of individual ingredients or it may be comprised together in a composition or a combination thereof. The benefit agent may be present on the outwardly facing first side of the substrate and/or on the inwardly facing second side of the substrate.

The benefit agent may be applied to the substrate in any number of ways including but not limited to spraying, printing, coating, and combinations thereof. The benefit agent may be directly applied to the substrate or it may be blended and added to the substrate with other components non-limiting examples of which are the adhesive, the barrier agent and/or the release agent. The benefit agent may be applied to the substrate in the form of an encapsulate and/or a particle. Non-limiting examples of encapsulates and/or particles which may be used include starch encapsulates, cyclodextrin, zeolite, and/or zeolite in starch particles. The benefit agent may be applied to the outwardly facing first side of the substrate, the inwardly facing second side of the substrate, or a combination thereof. It may be applied in a continuous, semi-continuous, or discontinuous pattern, or combinations thereof. Additionally, the benefit agent may be present in the substrate. For instance, the benefit agent could be mixed in with the substrate during the substrate manufacturing process and/or the benefit agent could be impregnated into the substrate.

When utilizing benefit agents with volatile components such as perfume, it may be desirable for the benefit agent to be applied to the substrate such that it resides on the outwardly facing first side of the substrate. It may also be desirable to utilize higher levels of the benefit agent which are localized in a small area(s) of the substrate. While not wishing to be bound by theory, it is thought that this can help improve the stability of the benefit agent over the course of the roller's life cycle from manufacturing to warehousing to usage. Furthermore, it is believed that this can help achieve effective transfer of the benefit agent from the roller to the fabric.

The benefit agent may also be applied to other areas of the roller. For instance, in one non-limiting embodiment, a benefit agent may be applied to the core of a roller. For example, a perfume could be applied to the core.

Perfume

In one non-limiting embodiment, the benefit agent may be comprised of from about 0.1% to about 100% of a perfume composition. When utilizing one or more benefit agents comprising perfume, it may be desirable that the scent from the perfume be evident on the roller. Furthermore, it is generally desirable that this scent not diminish through subsequent wraps of the substrate but remain constant through these subsequent wraps. It may also be desirable for the perfume scent to be evident in the environment surrounding the roller. Furthermore, it is desirable that the perfume scent be evident on the fabric after transfer of the perfume from the roller to the fabric and that the scent last for a considerable time after transfer. The perfume may be chosen from blooming perfume ingredients, transferable/substantive perfume ingredients, pro-perfume ingredients, low odor detection threshold perfume ingredients, and mixtures thereof.

The perfume composition may include one or more perfume ingredients having a boiling point less than about 260° C. (as measured or predicted at normal standard pressure of 760 mm Hg) and referred to herein as a "blooming" perfume ingredient. The perfume composition may also include one or more perfume ingredients having a boiling point of about 260° C. or more (as measured or predicted at normal standard pressure of 760 mm Hg) and referred to herein as a "transferable" or "substantive" perfume ingredient wherein the terms "transferrable" and "substantive" are used herein interchangeably. While not wishing to be bound by theory, it is believed that given the higher boiling point and lower volatility of transferable/substantive perfume ingredients, these ingredients will help provide longevity of scent on the roller, in the vicinity of the roller, on the fabric after contact of the roller to the fabric, and/or in the vicinity of the fabric after contact with the roller as these ingredients do not as readily volatilize as the lower boiling point perfume ingredients.

The perfume composition may be comprised of at least about 25% by weight of blooming perfume ingredients, or at least about 45% by weight of blooming perfume ingredients, or at least about 65% by weight of blooming perfume ingredients, or at least about 75% by weight of blooming perfume ingredients, or at least about 90% by weight of blooming perfume ingredients. The perfume composition may be comprised of at least about 25% by weight of substantive perfume ingredients, or at least about 45% by weight of substantive perfume ingredients, or at least about 60% by weight of substantive perfume ingredients, or at least about 75% of substantive perfume ingredients.

Blooming Perfume

The blooming perfume ingredients given their lower boiling points tend to be more volatile than the substantive perfumes which tend to have higher boiling points. The term "perfume" is used herein in the broadest sense to comprise, but not be limited to, high volatile perfume ingredients (i.e.; blooming perfume ingredients), transferable/substantive perfume ingredients, and mixtures thereof.

The boiling points of many perfume ingredients are given in, e.g., "Perfume and Flavor Chemicals (Aroma Chemicals)," S. Arctander, published by the author, 1969. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually at a pressure lower than the standard pressure (760 mm Hg), the boiling point at standard pressure can be approximately estimated by using boiling point-pressure nomographs, such as those given in "The Chemist's Companion," A. J. Gordon and R. A. Ford, John Wiley & Sons Publishers, 1972, pp. 30-36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306-316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301-310, and references cited therein, and "Predicting Physical Properties from Molecular Structure," R. Murugan et al, Chemtech, June 1994, pp. 17-23.

Non-limiting examples of blooming perfume ingredients (and their approximate boiling points in ° C. as measured at a standard pressure of 760 mm of Hg) that may be used in the present invention either individually or as mixtures are given in Table I:

TABLE I

Non-limiting Examples of Blooming Perfume Ingredients

| Perfume Ingredients | Approx. BP (° C.) |
|---|---|
| allo-Ocimene | 192 |
| Allyl Caproate | 185 |
| Allyl Heptoate | 210 |
| Amyl Acetate | 142 |
| Amyl Propionate | 161 |
| Anethol | 236 |
| Anisic Aldehyde | 248 |
| Anisole | 154 |
| Benzaldehyde | 179 |
| Benzyl Acetate | 215 |
| Benzyl Acetone | 235 |
| Benzyl Alcohol | 205 |
| Benzyl Butyrate | 240 |
| Benzyl Formate | 202 |
| Benzyl Iso Valerate | 246 |
| Benzyl Propionate | 222 |
| Beta Gamma Hexenol | 157 |
| Camphene | 159 |
| Camphor Gum | 208 |
| Carvacrol | 238 |
| laevo-Carveol | 227 |
| d-Carvone | 231 |
| laevo-Carvone | 230 |
| beta-Caryophyllene | 256 |
| Cinnamic Alcohol | 258 |
| Cinnamyl Formate | 250 |
| Citral (Neral) | 228 |

TABLE I-continued

Non-limiting Examples of Blooming Perfume Ingredients

| Perfume Ingredients | Approx. BP (° C.) |
|---|---|
| Citronellol | 225 |
| Citronellyl Acetate | 229 |
| Citronellyl Isobutyrate | 249 |
| Citronellyl Nitrile | 225 |
| Citronellyl Propionate | 242 |
| Cuminic alcohol | 248 |
| Cuminic aldehyde | 236 |
| Cyclal C | 180 |
| Cyclohexyl Ethyl Acetate | 187 |
| Decyl Aldehyde | 209 |
| Dihydro Myrcenol | 208 |
| Dihydromyrcenyl Acetate | 225 |
| Dimethyl Benzyl Carbinol | 215 |
| Dimethyl Benzyl Carbinyl Acetate | 250 |
| Dimethyl Octanol | 213 |
| Diphenyl Oxide | 252 |
| Dodecalactone | 258 |
| Ethyl Acetate | 77 |
| Ethyl Aceto Acetate | 181 |
| Ethyl Amyl Ketone | 167 |
| Ethyl Benzoate | 212 |
| Ethyl Butyrate | 121 |
| Ethyl Hexyl Ketone | 190 |
| Ethyl Methyl Phenyl Glycidate | 260 |
| Ethyl Phenyl Acetate | 229 |
| Eucalyptol | 176 |
| Eugenol | 253 |
| Fenchyl Acetate | 220 |
| Fenchyl Alcohol | 200 |
| Flor Acetate (tricyclo Decenyl Acetate) | 175 |
| Frutene (tricyclo Decenyl Propionate) | 200 |
| gamma Methyl Ionone | 230 |
| gamma-Nonalactone | 243 |
| Geraniol | 230 |
| Geranyl Acetate | 245 |
| Geranyl Formate | 216 |
| Geranyl Isobutyrate | 245 |
| Geranyl Nitrile | 222 |
| Hexenol | 159 |
| Hexenyl Acetate | 168 |
| cis-3-Hexenyl Acetate | 169 |
| Hexenyl Isobutyrate | 182 |
| cis-3-Hexenyl Tiglate | 101 |
| Hexyl Acetate | 172 |
| Hexyl Formate | 155 |
| Hexyl Neopentanoate | 224 |
| Hexyl Tiglate | 231 |
| Hydratropic Alcohol | 219 |
| Hydroxycitronellal | 241 |
| Indole | 254 |
| Isoamyl Alcohol | 132 |
| alpha-Ionone | 237 |
| beta-Ionone | 239 |
| gamma-Ionone | 240 |
| alpha-Irone | 250 |
| Isobornyl Acetate | 227 |
| Isobutyl Benzoate | 242 |
| Isobutyl Quinoline | 252 |
| Isomenthol | 219 |
| Isomenthone | 210 |
| Isononyl Acetate | 200 |
| Isononyl Alcohol | 194 |
| para-Isopropyl Phenylacetaldehyde | 243 |
| Isopulegol | 212 |
| Isopulegyl Acetate | 239 |
| Isoquinoline | 243 |
| cis-Jasmone | 248 |
| Lauric Aldehyde (Dodecanal) | 249 |
| Ligustral | 177 |
| Lilial (p-t-Bucinal) | 258 |
| d-Limonene | 177 |

TABLE I-continued

| Non-limiting Examples of Blooming Perfume Ingredients | |
|---|---|
| Perfume Ingredients | Approx. BP (° C.) |
| Linalool | 198 |
| Linalool Oxide | 188 |
| Linalyl Acetate | 220 |
| Linalyl Formate | 202 |
| Menthone | 207 |
| Menthyl Acetate | 227 |
| Methyl Acetophenone | 228 |
| Methyl Amyl Ketone | 152 |
| Methyl Anthranilate | 237 |
| Methyl Benzoate | 200 |
| Methyl Benzyl Acetate | 213 |
| Methyl Chavicol | 216 |
| Methyl Eugenol | 249 |
| Methyl Heptenone | 174 |
| Methyl Heptine Carbonate | 217 |
| Methyl Heptyl Ketone | 194 |
| Methyl Hexyl Ketone | 173 |
| alpha-iso "gamma" Methyl Ionone | 230 |
| Methyl-N-Methyl Anthranilate | 256 |
| Methyl Nonyl Acetaldehyde | 232 |
| Methyl Octyl Acetaldehyde | 228 |
| Methyl Phenyl Carbinyl Acetate | 214 |
| Methyl Salicylate | 223 |
| Myrcene | 167 |
| Neral | 228 |
| Nerol | 227 |
| Neryl Acetate | 231 |
| Nonyl Acetate | 212 |
| Nonyl Aldehyde | 212 |
| Octalactone | 230 |
| Octyl Alcohol (Octanol-2) | 179 |
| Octyl Aldehyde | 223 |
| Orange Terpenes (d-Limonene) | 177 |
| para-Cresol | 202 |
| para-Cresyl Methyl Ether | 176 |
| para-Cymene | 179 |
| para-Methoxy Acetophenone | 260 |
| para-Methyl Acetophenone | 228 |
| Phenoxy Ethanol | 245 |
| Phenyl Acetaldehyde | 195 |
| Phenyl Ethyl Acetate | 232 |
| Phenyl Ethyl Alcohol | 220 |
| Phenyl Ethyl Dimethyl Carbinol | 238 |
| Phenyl Hexanol | 258 |
| alpha-Pinene | 157 |
| beta-Pinene | 166 |
| Prenyl Acetate | 155 |
| Propyl Butyrate | 143 |
| Pulegone | 224 |
| Rose Oxide | 182 |
| Safrole | 234 |
| alpha-Terpinene | 176 |
| gamma-Terpinene | 183 |
| 4-Terpinenol | 212 |
| alpha-Terpineol | 219 |
| Terpinolene | 184 |
| Terpinyl acetate | 220 |
| Tetrahydro Linalool | 191 |
| Tetrahydro Myrcenol | 208 |
| Tonalid | 246 |
| Undecenal | 223 |
| Veratrol | 206 |
| Verdox | 221 |
| Vertenex | 232 |
| Viridine | 221 |

In one non-limiting embodiment, the blooming perfume composition may comprise at least about 3 different blooming perfume ingredients, or at least about 4 different blooming perfume ingredients, or at least about 5 different blooming perfume ingredients, or at least about 6 different blooming perfume ingredients. It may be desirable that the perfume compositions of the present invention include 15% or less of each of the following ingredients: linalool acetate, isobornyl acetate, and terpinyl acetate.

Substantive/Transferrable Perfume

Non-limiting examples of substantive perfume ingredients (and their approximate boiling points in ° C. as measured at 760 mm of Hg) that may be used in the present invention either individually or as mixtures are given in Table II:

TABLE II

| Non-limiting Examples of Transferable, Substantive Perfume Ingredients | |
|---|---|
| Perfume Ingredients | Approx. BP (° C.) |
| Acetoacet-m-xylidide | 333 |
| Acetoacet-o-anisidide | 338 |
| Acetoacet-o-toluidide | 319 |
| Acetosyringone | 315 |
| Acetoxymethyl-isolongifolene (isomers) | 314 |
| Acetyl triethyl citrate | 357 |
| Allyl 10-undecenoate | 281 |
| Benzophenone | 308 |
| Benzyl acetoacetate | 275 |
| Benzyl benzoate | 314 |
| Benzyl capronate | 277 |
| Benzyl caprylate | 300 |
| Benzyl cinnamate | 357 |
| Benzyl dipropyl ketone | 286 |
| Benzyl eugenol | 362 |
| Benzyl lactate | 275 |
| Benzyl laurate | 355 |
| Benzyl levulinate | 298 |
| Benzyl methyltiglate | 277 |
| Benzyl nicotinate | 324 |
| Benzyl octyl ether | 304 |
| Benzyl phenyl ether | 300 |
| Benzyl phenylacetate | 325 |
| Benzyl salicylate | 347 |
| beta-Alanine | 330 |
| beta-Asarone | 291 |
| beta-Bisabolene | 265 |
| beta-Bourbonene | 263 |
| beta-Caryophyllene | 269 |
| beta-Caryophyllene alcohol | 296 |
| beta-Ionol | 271 |
| beta-Ionone | 276 |
| beta-Ionone | 273 |
| beta-Ionyl acetate | 282 |
| Cinnamyl benzoate | 355 |
| Cinnamyl butyrate | 285 |
| Cinnamyl caproate | 316 |
| Cinnamyl cinnamate | 387 |
| Cinnamyl isobutyrate | 276 |
| Cinnamyl isovalerate | 294 |
| Cinnamyl nitrile | 266 |
| Cinnamyl phenylacetate | 371 |
| Cinnamyl propionate | 270 |
| Cinnamyl tiglate | 297 |
| cis,trans-Phytol | 362 |
| cis-2-Methoxycinnamic acid | 311 |
| cis-3-Hexenyl anthranilate | 294 |
| cis-3-Hexenyl benzoate | 283 |
| cis-3-Hexenyl cinnamate | 315 |
| cis-3-Hexenyl heptine carbonate | 278 |
| cis-3-Hexenyl octine carbonate | 307 |
| cis-3-Hexenyl phenylacetate | 288 |
| cis-3-Hexenyl salicylate | 316 |
| cis-cis-Farnesol | 312 |
| Citral diethyl acetal | 263 |
| Citral propylene glycol acetal | 268 |
| Citric acid | 392 |
| Citronellal di-isotridecyl acetal | 394 |
| Citronellic acid | 264 |

TABLE II-continued

Non-limiting Examples of Transferable, Substantive Perfume Ingredients

| Perfume Ingredients | Approx. BP (° C.) |
|---|---|
| Citronellyl 3-methyl-2-butenoate | 276 |
| Citronellyl anthranilate | 343 |
| Dimethyl benzyl carbinyl isobutyrate | 263 |
| Dimethyl phenethyl carbinyl isobutyrate | 280 |
| Dimethyl phthalate | 262 |
| Dimethyl-alpha-ionone | 290 |
| Diphenyl | 262 |
| Diphenylamine | 288 |
| Diphenylmethane | 269 |
| Diphenyloxide | 269 |
| dl-.beta.-Tocopherol | 426 |
| DL-2-Aminopropanoic acid | 275 |
| dl-Alpha-Tocopherol | 468 |
| dl-Methionine | 310 |
| dl-Phenylalanine | 351 |
| DL-Tartaric acid | 357 |
| dl-Valine | 272 |
| Dodecanal dimethyl acetal | 271 |
| Dodecenoic acid | 299 |
| Dodecyl butyrate | 313 |
| Dodecyl isobutyrate | 304 |
| Dodecyl lactate | 331 |
| Dodecyl propionate | 300 |
| Elemol | 284 |
| Ethyl stearate | 371 |
| Ethyl undecanoate | 264 |
| Ethyl undecylenate | 264 |
| Ethyl vanillate | 286 |
| Ethyl vanillin | 286 |
| Ethyl vanillin acetate | 314 |
| Ethyl vanillin propylene glycol acetal | 327 |
| Ethylene brassylate | 390 |
| Ethylhexyl palmitate | 392 |
| Eugenol | 263 |
| Eugenol tetrahydropyranyl | 332 |
| Eugenyl acetate | 280 |
| Eugenyl benzoate | 356 |
| Eugenyl formate | 269 |
| Eugenyl phenylacetate | 398 |
| exo-2-Camphanyl beta-hydroxyethyl ether | 267 |
| Farnesal | 294 |
| Farnesol | 317 |
| Farnesyl acetate | 318 |
| Farnesyl methyl ether | 302 |
| Ferulic acid | 371 |
| Formaldehyde (indan-1-ol-2-hydroxymethyl) acetal | 270 |
| Formaldehyde cyclododecyl ethyl acetal | 308 |
| Formaldehyde cyclododecyl methyl acetal | 287 |
| Formoxymethyl-isolongifolene | 306 |
| Formylethyltetramethyltetralin | 330 |
| Fumaric acid | 276 |
| Furfuryl benzoate | 288 |
| Furfuryl heptanoate | 272 |
| Furfuryl octanoate | 288 |
| Furfuryl thiopropionate | 267 |
| gamma-Dodecalactone | 281 |
| gamma-Dodecen-6-lactone | 274 |
| gamma-Ionone | 262 |
| gamma-Undecalactone | 260 |
| Geranyl acetoacetate | 291 |
| Geranyl anthranilate | 350 |
| Geranyl benzoate | 328 |
| Geranyl butyrate | 268 |
| Geranyl caprylate | 325 |
| Geranyl crotonate | 271 |
| Geranyl cyclopentanone | 316 |
| Geranyl hexanoate | 294 |
| Geranyl isobutyrate | 288 |
| Geranyl isovalerate | 278 |

TABLE II-continued

Non-limiting Examples of Transferable, Substantive Perfume Ingredients

| Perfume Ingredients | Approx. BP (° C.) |
|---|---|
| Geranyl linalool (all trans) | 359 |
| Geranyl oxyacetaldehyde | 265 |
| Geranyl phenylacetate | 353 |
| Geranyl tiglate | 283 |
| Hexyl nonanoate | 320 |
| Hexyl octanoate | 282 |
| Hexyl phenylacetate | 292 |
| Hexyl tetradecanoate | 364 |
| Hexyl vanillate | 334 |
| Hinokitiol | 308 |
| Hydrocinnamic acid | 280 |
| Hydroquinone, 2,5-di-tert-butyl- | 325 |
| Hydroxycitronellal diethyl acetal | 289 |
| Hydroxycitronellal-Indole (Schiff base) | 360 |
| Hydroxycitronellol | 274 |
| Hydroxymethyl-isolongifolene in dipropylene glycol | 299 |
| Icosane | 339 |
| Indan, 1-phenyl-1,3,3-trimethyl | 341 |
| Indol/Hydroxycitronellal Schiff base | 488 |
| Ionone | 276 |
| iso Propyl dodecanoate | 284 |
| Isoamyl 3-(2-furan)propionate | 264 |
| Isoamyl 4-(2-furan)butyrate | 279 |
| Isoamyl benzoate | 260 |
| Isoamyl cinnamate | 303 |
| Isoamyl decanoate | 285 |
| Isoamyl geranate | 285 |
| Isoamyl heptine carbonate | 261 |
| Isoamyl laurate | 321 |
| Isoamyl nonanoate | 273 |
| Isoamyl phenylacetate | 272 |
| Isoamyl p-methoxycinnamate | 330 |
| Linalyl isovalerate | 268 |
| Linalyl octanoate | 320 |
| Linalyl pentanoate | 279 |
| Linalyl phenylacetate | 340 |
| Linolenic acid | 390 |
| l-Malic acid | 340 |
| l-Menthyl lactate | 294 |
| l-Menthyl phenylacetate | 333 |
| l-Menthyl salicylate | 350 |
| Longifolene | 260 |
| L-Tartaric acid | 357 |
| Lyral (fraction) | 320 |
| Lyral (fraction) | 319 |
| Lyral/Methyl anthranilate (Schiff Base) | 456 |
| Lysine L monochlorohydrate | 376 |
| Malonic acid | 265 |
| Maltyl butyrate | 274 |
| Maltyl isobutyrate | 277 |
| Margaryl alcohol | 358 |
| Menthyl isovalerate | 285 |
| Menthyl valerate | 287 |
| Methoxy ethyl phenyl glycidate | 297 |
| Methyl 1-naphthyl ketone | 310 |
| Methyl 2,4-dihydroxy-3,6-dimethylbenzoate | 318 |
| Methyl 2-hexyl-3-oxo-cyclopentanecarboxylate | 311 |
| Nerolidyl acetate | 297 |
| Nerolidyl acetate | 287 |
| Nerolidyl isobutyrate | 319 |

TABLE II-continued

| Non-limiting Examples of Transferable, Substantive Perfume Ingredients | |
|---|---|
| Perfume Ingredients | Approx. BP (° C.) |
| Neryl butyrate | 343 |
| Neryl isobutyrate | 271 |
| Neryl isovalerate | 283 |
| Octenyl cyclopentanone | 269 |
| Octyl caprate | 340 |
| Octyl caproate | 282 |
| Octyl caprylate | 314 |
| Octyl heptanoate | 300 |
| Octyl nonanoate | 327 |
| Octyl phenylacetate | 321 |
| Octyl salicylate | 341 |
| Oleic acid | 384 |
| Oleyl alcohol | 371 |
| Phenethyl isoamyl ether | 266 |
| Phenethyl isothiocyanate | 265 |
| Phenethyl isovalerate | 272 |
| Phenethyl octanoate | 323 |
| Phenethyl phenylacetate | 335 |
| Phenethyl pivalate | 263 |
| Phenethyl salicylate | 358 |
| Phenethyl senecioate | 277 |
| Phenethyl tiglate | 275 |
| Phenoxyacetic acid | 278 |
| Phenoxyethyl propionate | 263 |
| Phenyl benzoate | 303 |
| Phenyl disulfide | 332 |
| Phenyl salicylate | 338 |
| Phenyl xylyl ethane | 320 |
| Rhodinyl isovalerate | 260 |
| Rhodinyl phenylacetate | 343 |
| Rosyrane | 263 |
| Salicylic acid | 260 |
| Santalol (Alpha and Beta) | 296 |
| Santalyl acetate | 336 |
| Santalyl butyrate | 322 |
| Santalyl phenylacetate | 368 |
| Tetrahydroionyl acetate | 271 |
| Tetrahydro-pseudo-ionone | 285 |
| Tetrahydropyranoxyeugenol | 290 |
| Theobromine | 395 |
| Threonine | 305 |
| Thymol, acetate | 262 |
| Undecylenic acid | 290 |
| Undecylenic aldehyde digeranyl acetal | 445 |
| Valencene | 260 |
| Vanillic acid | 315 |
| Vanillin | 272 |
| Vanillin acetate | 289 |

Additional non-limiting examples of transferable, substantive perfume ingredients, useful in the present invention, include: Acetaldehyde benzyl methoxyethyl acetal, Acetaldehyde butyl phenylethyl acetal, Acetaldehyde dihexyl acetal, Acetaldehyde diphenylethyl acetal, Acetaldehyde ethyl geranyl acetal, Acetaldehyde ethyl isoeugenyl acetal, Acetaldehyde ethyl neryl acetal, Acetaldehyde phenylethyl propyl acetal, Allyl alpha-ionone, Allyl anthranilate, Allyl cinnamate, Allyl cyclohexanebutyrate, Allyl cyclohexanehexanoate, Allyl cyclohexanevalerate, Allyl decanoate, alpha,alpha-Dimethyl-p-ethylphenylpropanal, alpha,alpha-Dimethyl-p-ethylphenylpropanal, alpha,beta,2,2,3-Pentamethylcyclopent-3-ene-1 butanol-1, alpha-Amylcinnamaldehyde, alpha-Amylcinnamaldehyde diethyl acetal, alpha-Amylcinnamaldehyde dimethyl acetal, alpha-Amylcinnamyl acetate, alpha-Amylcinnamyl alcohol, alpha-Amylcinnamyl formate, alpha-Amylcinnamyl isovalerate, alpha-Bisabolol, alpha-Butylcinnamaldehyde, alpha-Camphorene, alpha-Cedrene epoxide, alpha-Cubebene, alpha-Ethyl benzyl butyrate, alpha-Farnesene, alpha-Furoic acid, octyl ester, alpha-Hexylcinnamaldehyde, alpha-Ionol, alpha-Ionone, alpha-Ionyl acetate, alpha-Irone, alpha-Isomethylionone, alpha-Methylcinnamic alcohol, alpha-Methylionone, alpha-Methylphenethyl butyrate, alpha-Naphthyl butyrate, alpha-Propylphenethyl alcohol, alpha-Santalol, alpha-Terpinyl anthranilate, alpha-Terpinyl isobutyrate, alpha-Vetivone, Aminoacetic acid, Amyl cinnamic aldehyde, digeranyl acetal, Amyl cinnamic aldehyde, dilinallyl acetal, Amyl cinnamic aldehyde/methyl anthranilate (Schiff Base), Amyl isoeugenyl ether, Amyl laurate, Anisaldehyde diethyl acetal, Anisyl butyrate, Anisyl phenylacetate, Anisyl propionate, Anisylpropanal, Apiole, Apocynin, Aroma Ionone fraction/Soda, Aroma Ionone fraction/Soda, Asaronaldehyde, Asarone, Asparagine, Aspartame, Azelaic acid, Azodicarbonamide, Benzaldehyde glyceryl acetal, Benzoguanamine, Benzohydrol, Benzoin, beta-Irone, beta-Naphthyl anthranilate, beta-Naphthyl ethyl ether, beta-Naphthyl isobutyl ether, beta-Naphthyl methyl ether, beta-Santalol, beta-Sinensal, Bicyclic ethyl esters, Bis(2,5-dimethyl-3-furyl) disulfide, Bis(2-ethylhexyl) adipate, Bis(2-ethylhexyl) sebacate, Bis(2-methyl-3-furyl) disulfide, Bisabolene, Bornane-3,1-cyclopentanone-2, Bornyl butyrate, Bornyl isobutyrate, Bornyl isovalerate, Bornyl valerate, Butyl 10-undecenoate, Butyl 2-decenoate, Butyl anthranilate, Butyl cinnamate, Butyl decanoate, Butyl hexadecanoate, Butyl laurate, Butyl myristate, Butyl oleate, Butyl phenylacetate, Butyl stearate, Butylated hydroxyanisole, Butylated hydroxytoluene, Butylparaben, C12E4OH, Caffeine, Calarene epoxide, Capric acid, Caproleic acid, Capsaicin, Carvacrol, acetate, Carvyl propionate, Caryophyllene acetate, Caryophyllene alcohol, Caryophyllene alcohol acetate, Caryophyllene oxide, Catechol methyl hexyl ketal, Cedrenol, Cedrenone, Cedrenyl acetate, Cedrol, Cedrol methyl ether, Cedroxyde, Cedryl acetate, Cedryl formate, Cetane, Cetyl alcohol, Chalcone, Cinnamaldehyde ethylene glycol acetal, Cinnamic acid, Cinnamic aldehyde butylene glycol acetal, Cinnamonitrile, Cinnamyl acetate, Cinnamyl anthranilate, Citronellyl benzoate, Citronellyl butyrate, Citronellyl caproate, Citronellyl crotonate, Citronellyl ethyl oxalate, Citronellyl isobutyrate, Citronellyl isovalerate, Citronellyl phenylacetate, Citronellyl tiglate, Citronellyl valerate, Citronellyloxyacetaldehyde, Civetone, Coniferyl alcohol, Coumarin, Curcumin, Cyclamen alcohol, Cyclamen aldehyde, Cyclic ethylene dodecanedioate, Cyclododecanol, Cyclododecyl acetate, Cyclododecyl formate, Cyclododecyl methyl ether, Cyclohexadec-4-enone, Cyclohexane, 1-(2-phenylethoxy)-Cyclohexanepropionic acid, Cyclohexanol, (5,5,6-trimethyl-2-norbornyl), Cyclohexyl, anthranilate, Cyclohexyl cinnamate, Cyclohexyl phenylacetate, Cyclohexyl salicylate, Cyclopent-2-ene-1-acetic acid, cyclohexyl & 2-octyl esters, Cyclopentadecanone, Cyclotene pentyl ether, d,l-Isoleucine, d-.gamma.-Tocopherol, Decamethylene glycol, Decanal diethyl acetal, Decyl anthranilate, Decyl butyrate, Decyl propionate, Dehydroacetic acid, Dehydrodihydroionone, delta-2-Decenoic acid, delta-Dodecalactone, delta-Tetradecalactone, delta-Tocopherol, delta-Tridecalactone, Di-(butan-3-one-1-yl) sulfide, Dibenzosuberenone, Dibenzyl disulfide, Dibenzyl ether, Dibenzyl ketone, Dibenzylamine, Dibutyl malate, Dibutyl phthalate, Dibutyl sebacate, Dibutyl succinate, Dicyclohexyl disulfide, Diethyl azelate, Diethyl phthalate, Diethyl sebacate, Diethyl suberate, Diethyl tartrate, Dihexyl fumarate, Dihydro geranyl linalool, Dihydro-alpha-ionone, Dihydro-alpha-terpinyl acetate, Dihydro-beta-ionol, Dihydro-beta-ionone, Dihydromethyl-alpha-ionone, Dihydronootkatone, Di-isoamyl thiomalate, Diisobutyl adipate, Dimethyl azelate, Dimethyl benzyl carbinyl butyrate, Epoxyguaiene, Erythorbic acid, Ethanone-1,4-butoxy-2,2,6,6-tetramethyl-3-cyclohexenyl-1, Ethanone-1,4-methoxy-2,2,6,6-tetramethyl-3-cyclohexenyl-1, Ethyl (p-tolyloxy)acetate, Ethyl 2-acetyl-3-phenylpropionate, Ethyl 2-methyl-6-pentyl-4-oxocyclohex-2-ene-carboxylate, Ethyl 2-tert.butylcyclohexyl carbonate, Ethyl 3-(furfurylthio)propionate, Ethyl 3,5,5-trimethylcyclohexylglycidate, Ethyl 3-hydroxy-3-phenylpropionate, Ethyl 3-phenylglycidate, Ethyl 4-hydroxybenzoate, Ethyl 4-phenylbutyrate, Ethyl aconitate (mixed esters), Ethyl anthranilate/dimethylcyclohex-3-ene-1-carbaldehyde Schiff base, Ethyl benzoylacetate, Ethyl cinnamate, Ethyl decine carbonate, Ethyl heptadecanoate, Ethyl laurate, Ethyl linoleate, Ethyl linolenate, Ethyl methylphenylglycidate, Ethyl methyl-p-tolyglycidate, Ethyl myristate, Ethyl norbornyl cyclohexanol, Ethyl oleate, Ethyl palmitate, Ethyl pentadecanoate, Ethyl p-tolylglycidate, Geranyl valerate, Geranylacetone, Germacrone, Glucose pentaacetate, Glycerin tridecanoate, Glycerol trioctanoate, Glyceryl 5-hydroxydecanoate, Glyceryl distearate, Glyceryl mono/dioleate, Glyceryl monooleate, Glyceryl monostearate, Glyceryl tribenzoate, Glyceryl tributanoate, Glyceryl tripropanoate, Guaiacyl phenylacetate, Guaiazulene, Guaiene, Guaiol, Guaiyl acetate, Heliotropin, Heliotropine diethyl acetal, Heliotropine dimethyl acetal, Heliotropyl acetate, Heptanal glyceryl acetal (mixed 1,2 and 1,3 acetals), Heptyl caproate, Heptyl cinnamate, Heptyl heptanoate, Heptyl octanoate, Heptyl phenylacetate, Heptyl propionate, Hexadeca-1,4-lactone, Hexadecalactone, Hexadecanolide, Hexadecyl acetate, Hexahydro-1,1,5,5-tetramethyl-2H-2,4a-methanophtalen-8(5H)-one (isomers), Hexahydro-3,6,8,8-tetramethyl-1H-3a,7-methanoazulen-5(4H)-one, Hexahydro-4,7-methanoinden5(6)yl isobutyrate, Hexahydro-4,7-methanoinden-5(6)-yl pivalate, Hexahydro-4,7-methanoindene-5-carboxaldehyde diethyl acetal, Hexyl benzoate, Hexyl dodecanoate, Isoamyl undecylenate, Isobornyl isovalerate, Isobutyl anthranilate, Isobutyl benzyl carbinol, Isobutyl cinnamate, Isobutyl ionone, Isobutyl N-methylanthranilate, Isobutyl quinoline, Isobutyl salicylate, Isoeugenol, Isoeugenyl acetate, Isoeugenyl benzyl ether, Isoeugenyl ethyl ether, Isoeugenyl formate, Isoeugenyl phenylacetate, Isohexenyl cyclohexenyl carboxaldehyde, Isolongifolanone (& epi), Isolongifolene ketone, iso-Methyl Tetrahydroionol, iso-Methyl Tetrahydroionyl acetate, Isomethyl-beta-ionone, Isononylaldehyde/Methylanthranilate Schiff base, Isopentyl salicylate, Isophytol, Isopropyl 10-undecenoate, Isopropyl cinnamate, Isopropyl myristate, Isopropyl palmitate, Isotridecyl acetate, Isotridecyl alcohol, Lauric acid, Lauronitrile, Lauryl acetate, Lauryl alcohol, Leaf alcohol (di cis-3 hexenyl) acetal, Linalyl anthranilate, Linalyl benzoate, Linalyl cinnamate, Linalyl hexanoate, Methyl 2-nitrobenzoate, Methyl 2-undecynoate, Methyl 3-methylresorcylate, Methyl 4-methoxysalicylate, Methyl abietate, Methyl alpha-ionone glycidate, Methyl alpha-ionyl acetate, Methyl anthranilate/2-methyl-3-(4-methoxyphenyl)propanal Schiff base, Methyl anthranilate/2-methylpentanal Schiff base, Methyl anthranilate/alpha-amylcinnamic aldehyde Schiff base, Methyl anthranilate/anisic aldehyde Schiff base, Methyl anthranilate/citral Schiff base, Methyl anthranilate/Citronellal Schiff base, Methyl anthranilate/cyclamen aldehyde Schiff base, Methyl anthranilate/Decanal Schiff base, Methyl anthranilate/hydroxycitronellal Schiff base, Methyl anthranilate/iso-nonylaldehyde Schiff base, Methyl anthranilate/lilial Schiff base, Methyl anthranilate/nonanal Schiff base, Methyl anthranilate/Octanal Schiff base, Methyl anthranilate/phenylacetaldehyde Schiff base, Methyl beta-ionol, Methyl Beta-ionol, Methyl Beta-ionyl acetate, Methyl beta-ionyl acetate, Methyl beta-naphthyl ketone, Methyl cedryl ketone, Methyl dihydrojasmonate, Methyl epijasmonate, Methyl hexadecanoate, Methyl jasmonate, Methyl laurate, Methyl lavender ketone, Methyl linoleate, Methyl linolenate, Methyl myristate, Methyl N-{4(4-HO-4-methylpentyl)-3-cyclohexen-1-yl}methyleneanthranilate, Methyl N-formyl anthranilate, Methyl oleate, Methyl p-tert-butylphenylacetate, Methyl stearate, Methyl tridecanoate, Methyl undecyl ketone, Methyl vanillate, Methyl-beta-ionone, Methyl-delta-ionone, Methylionone (mixture of isomers), Methyltetradecylketone, Tricyclodecanedimethanol, tonalid, lilial, dipropyleneglycol, Monosodium glutamate, Moskene, Muscone, Musk ambrette, Musk ketone, Musk tibetine, Musk xylol, Myristaldehyde, Myristic acid, Myristyl nitrile, N-2,4-Dimethyl-3-cyclohexenemethylene methyl anthranilate, N-Acetyl methyl anthranilate, N-Acetylindole, Naphtofuran Dodecahydro-3a,6,6,9a-tetramethyl [3aR-(3a alpha,5a beta,9a alpha,9b beta)], n-Docosane, Nerolidol, N-Ethyl-2-isopropyl-5-methylcyclohexane carboxamide, n-Hexyl ethyl acetoacetate, n-Hexyl salicylate, N-Methyl-N-phenyl-2-methyl butyramide, Nonanoyl 4-hydroxy-3-methoxybenzylamide, Nonyl isovalerate, Nonyl octanoate, Nootketone, Nopyl acetate, n-Pentyl benzoate, n-Pentyl cinnamate, n-Pentyl decanoate, n-Pentyl octanoate, n-Pentyl phenylacetate, n-Pentyl salicylate, Octahydro-4,7-methanoindanilydenebutanal, Methoxycinnamaldehyde, o-Phenyl anisol, o-Tolyl salicylate, Oxacycloheptadec-10-en-2-one, Oxybenzone, Palmitic acid, Palmitoleic acid, p-Anisic acid, Patchouli alcohol, p-Cresyl benzoate, p-Cresyl caprylate, p-Cresyl salicylate, Pelargonic acid, butyl ester, Pentadecaldehyde, Pentadecanolide, Pentanedioic acid, Phenethyl 2-furoate, Phenethyl 2-methylbutyrate, Phenethyl anthranilate, Phenethyl benzoate, Phenethyl butyrate, Phenethyl cinnamate, Phenethyl crotonate, Phenethyl hexanoate, Phenylacetaldehyde 2,3-butylene glycol acetal, Phenylacetaldehyde dibenzyl acetal, Phenylacetaldehyde digeranyl acetal, Phenylacetaldehyde diisobutyl acetal, Phenylacetaldehyde glyceryl acetal, Phenylacetaldehyde hexylene glycol acetal, Phenylacetic acid, Phenylethyl methyl ethyl carbinyl acetate, Phthalic acid, p-Hydroquinone, p-Hydroxybenzyl alcohol, Phytol, Phytyl acetate, Pimelic acid, Piperine, Piperonyl acetone, Piperonyl alcohol, Piperonyl formate, Piperonyl isobutyrate, Piperonyl propionate, p-Mentha-8-thiol-3-one, p-Menthanediol-3,8 (in mixture), p-Methoxy-alpha-methyl cinnamaldehyde, p-Methoxybenzalacetone, p-Methoxycinnamaldehyde, Prenyl benzoate, Prenyl salicylate, Propanoic acid, 2-amino-3-mercapto-, (R)-Propenylguaethol, Propyl anthranilate, Propyl cinnamate, Propyl gallate, Propyl laurate, Propyl salicylate, Propyl trans-2,cis-4-decadienoate, Propylene glycol dibenzoate, Propylene glycol monolaurate, Propylene glycol stearate, Propylparaben, Protocatechualdehyde, p-Salicylic acid, Pseudo methyl ionones, Pseudoionone, p-t.Butylacetophenone, p-tert. Butyl-alpha-methyldihydrocinnamic aldehyde, p-Tolyl phenylacetate, Quinic acid, Resorcinol, Rhodinyl butyrate, Rhodinyl isobutyrate, Sclareol, Sclareolide, Serine, Sinensal, Skatole, Sodium 2-(4-methoxy phenoxy) propanoate, Sorbitol, Spiro(2,4-dithia-1-methyl-8-oxabicyclo[3.3.0]octane-3,3') Squalane, Squalene, Stearic acid, Stearic acid, isopentyl ester, Stearyl alcohol, Suberonitrile, Succinic acid, Sucrose octaacetate, Syringaldehyde, Tartaric acid, D-(−)-Taurine, TBHQ, Terpin, Terpinyl butyrate, Terpinyl cinnamate, Terpinyl isovalerate, Tetradecyl alcohol, Tolualdehyde glyceryl acetal, trans-2-Dodecen-1-ol, trans-2-Dodecenyl acetate, trans-2-Hexenyl phenylacetate, trans-2-Hexenyl salicylate, trans-2-Tetradecenal, trans-2-Tridecen-1-ol, trans-2-Undecenyl acetate, trans-Cinnamic acid, trans-Decahydro-2-naphthyl isobutyrate, trans-Nerolidol, Tributyl acetylcitrate, Tributyl citrate, Trichloromethyl phenyl carbinyl acetate, Tricyclodecanedimethanol, Tricyclopentadiene, Tridecanal, Tridecyl alcohol, Triethanolamine, Triethyl citrate, Triethylene glycol, Trimethylamine oxide, Triplal/Methyl anthranilate Schiff base, Trithioacetone, Tromethamine, Tyramine, Umbelliferone, Undec-10-ene, 1,1-di(3,7-dimethyloct-6-enoxy), Undecanal diethyl acetal, Undecanoic acid, Undecyl acetate, Vanillin propylene glycol acetal, Vanillyl alcohol, Vanillyl butyl ether, Vanillylidene acetone, Veratric acid, Vetivert Acetate, Vetiveryl acetate, Zingerone, and mixtures thereof.

The substantive perfume compositions of the present invention may contain at least about 3 different substantive perfume ingredients, or at least about 4 different substantive perfume ingredients, or at least about 5 different transferable, substantive perfume ingredients.

Diluents and Extenders

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., diluting and stabilizing some other perfume ingredients. For purposes of this invention, these materials are not considered a blooming perfume ingredient or a substantive perfume ingredient.

Pro-Perfume

A pro-perfume may optionally be included as part of the perfume composition. The term "pro-perfume" is herein defined to include: pro-fragrances, pro-perfumes, pro-accords, and mixtures thereof. Such pro-perfume may include acetal pro-perfumes, ketal pro-perfumes, ester pro-perfumes (e.g., digeranyl succinate), hydrolyzable inorganic-organic pro-perfumes, and mixtures thereof. These pro-perfumes are generally nonvolatile materials that release or convert to a perfume ingredient as a result of, e.g., simple hydrolysis; or may be pH-change-triggered pro-perfumes (e.g. triggered by a pH drop); or may be enzymatically releasable pro-perfumes; or light-triggered pro-perfumes. The pro-perfumes can exhibit various release rates depending upon the pro-perfume chosen. Pro-perfumes suitable for use in the compositions of the present invention are described in the following U.S. Pat. No. 5,378,468, Suffis et al., issued Jan. 3, 1995; U.S. Pat. No. 5,626,852, Suffis et al., issued May 6, 1997; U.S. Pat. No. 5,710,122, Sivik et al., issued Jan. 20, 1998; U.S. Pat. No. 5,716,918, Sivik et al., issued Feb. 10, 1998; U.S. Pat. No. 5,721,202, Waite et al., issued Feb. 24, 1998; U.S. Pat. No. 5,744,435, Hartman et al., issued Apr. 25, 1998; U.S. Pat. No. 5,756,827, Sivik, issued May 26, 1998; U.S. Pat. No. 5,830,835, Severns et al., issued Nov. 3, 1998; U.S. Pat. No. 5,919,752, Morelli et al., issued Jul. 6, 1999; WO 00/02986 published Jan. 20, 2000, Busch et al.; and WO 01/04248 published Jan. 18, 2001, Busch et al.

Perfume Microcapsule

All or some portion of the perfume composition may be provided in the form of a perfume microcapsule comprising a perfume carrier and an encapsulated perfume composition. The perfume microcapsule provides a latent source of perfume that can partially or totally replace the neat, free perfume in the composition. While not wishing to be bound by theory, this reduction of the amount of the neat perfume is believed to help improve the long lasting fabric freshness benefit after treatment.

Cellular Matrix Microcapsule

All or some portion of the perfume composition may be provided in the form of perfume cellular matrix microcapsules. Perfume cellular matrix perfume microcapsules, such as those that are moisture/friction activated and/or water-soluble, are solid particles containing perfume stably held in cells within the particles. Details about perfume cellular matrix microcapsules are disclosed in PCT Publication WO 01/85888 published Nov. 15, 2001 and U.S. Pat. No. 3,971,852 issued Jul. 27, 1976 to Benner et al. One suitable moisture-activated perfume cellular matrix microcapsule is a perfume starch microcapsule which uses starch as the cellular matrix material. Moisture-activated perfume cellular matrix microcapsules typically have a size of from about 0.5 micron to about 300 microns, or from about 1 micron to about 200 microns, or from about 2 microns to about 100 microns. The perfume loading in the cellular matrix microcapsules may range from about 20% to about 70%, or from about 40% to about 60%, by weight of the microcapsules. Sufficient amount of perfume cellular matrix microcapsules should be used to deliver the desired levels of perfume, depending on the perfume loading of the microcapsules. For microcapsules with a perfume loading of about 50%, a typical level of the matrix microcapsules is from about 0.1% to about 15%, or from about 0.5% to about 10%, or from about 0.8% to about 8%, and or from about 1% to about 6%, by weight, of the total benefit agent.

Porous Carrier Microcapsule.

All or some portion of the perfume composition can also be encapsulated by being absorbed onto and/or into a porous carrier, such as zeolite or clay, to form perfume porous carrier microcapsule in order to reduce the amount of free perfume in the roller of the present invention. When the perfume is to be adsorbed onto zeolite, the perfume ingredients forming the encapsulated perfume composition can be selected according to the description provided in U.S. Pat. No. 5,955,419 issued Sep. 21, 1999, to Barket, Jr., et al. Perfume ingredients that are suitable for use with porous mineral carrier materials, such as zeolites (including but not limited to dehydrated/activated zeolites) or clays, generally tend to be those that do not comprise a high level of unstable perfume ingredients that degrade upon incorporation into the porous mineral carrier materials. Non-limiting examples of such perfumes are provide in U.S. Pat. Application Publication No. 2003/0013632 A1 published Jan. 16, 2003 in the name of Santos et al.

C. Adhesive

The substrate of the present invention may include an adhesive. Typically the adhesive is present on the outwardly facing first side of the substrate for purposes of providing contaminant removal from the surface of a fabric. When included, the adhesive is most generally applied to the outwardly facing first side of the substrate. The adhesive may be present on the substrate in an amount of about 5 grams/$m^2$ of substrate to about 50 grams/$m^2$ of substrate, or about 10 grams/$m^2$ to about 35 grams/$m^2$, or about 15 grams/$m^2$ to about 30 grams/$m^2$.

A non-limiting list of adhesives which may be used with the present invention include polyacrylate; polyvinyl ether; diene-containing rubber including but not limited to natural rubber, polyisoprene, and polyisobutylene; polychoroprene, butyl rubber, butadiene-acrylonitrile polymer; thermoplastic elastomer; block copolymers including but not limited to styrene-isoprene and styrene-isoprene-styrene block copolymers, ethylene-propylene-diene polymers, and styrene-butadiene polymers; poly-alpha-olefin; amorphous polyolefin; silicone; ethylene-containing copolymer such as ethylene vinyl acetate; ethylacrylate, and ethyl methacrylate; polyurethane; polyamide epoxide; polyvinylpyrrolidone and vinylpyrrolidone copolymers; polyesters; and mixtures thereof. The adhesive may be a pressure sensitive adhesive. One non-limiting example of a suitable adhesive is one having a Loop Tack of about 4 lbs/inch of width (71 grams/mm of width) on stainless steel at a coat weight of about 25 grams/square meter in accordance with ASTM D-6195. One suitable hot melt adhesive is sold as HM-1902× and commercially available from H. B. Fuller of St. Paul, Minn.

The adhesive may be applied to the substrate in a number of different forms, non-limiting examples of which include as a hot melt, a solvent coating, and/or in a latex formulation. The adhesive may be applied to the substrate in a number of ways familiar to those of ordinary skill in the art including but not limited to spraying, printing, coating, embossing, and combinations thereof. The adhesive may also be blended in with the substrate during the substrate manufacturing process. Additionally, the adhesive can be impregnated into the substrate. The adhesive may be directly applied to the substrate. It can be applied to the substrate separately from other components or it may be blended and applied with other components. The adhesive may be applied to the entire substrate or to portions thereof. It may be applied in discrete locations. It may be applied in a continuous, semi-continuous, or discontinuous pattern, or combinations thereof.

D. Release Agent

One or more release agents may be included with the roller of the present invention. The release agent may be present on the outwardly facing first side of the substrate and/or the inwardly facing second side of the substrate in order to facilitate removal of an individual substrate wrap from the roller and to facilitate unwinding and rolling of the substrate during the manufacturing process. When included, the release agent is most generally applied to the inwardly facing first side of the substrate. The release agent may be present on the substrate in an amount of about 0.1 grams/$m^2$ to about 50 grams/$m^2$, about 0.5 grams/$m^2$ to about 10 grams/$m^2$, or about 1 grams/$m^2$ to about 5 grams/$m^2$.

The release agent may be applied to the substrate in a number of ways familiar to those of ordinary skill in the art including but not limited to spraying, printing, coating, embossing, and combinations thereof. The release agent may also be blended in with the substrate during the substrate manufacturing process. Additionally, the release agent can be impregnated into the substrate. The release agent may be directly applied to the substrate. It can be applied to the substrate separately from other components or it may be blended and applied with other components. The release agent may be applied to the entire substrate or to portions thereof. It may be applied in discrete locations. It may be applied in a continuous, semi-continuous, or discontinuous pattern, or combinations thereof.

Non-limiting examples of suitable release agents include silicones; fluorochemicals including but not limited to fluorocarbons; polycarbamates; and combinations thereof. One suitable release agent is a polycarbamate sold as Mayzo RA-95H and available from Mayzo Chemical of Norcross, Ga. Suitable thermally cured release agents also include the SYL-OFF® series of silicone release coatings commercially available from Dow Corning of Midland, Mich.

In one non-limiting embodiment, the release agent may be comprised of more than one component. For instance, in one non-limiting example the release agent may be comprised of an easy release polymer (a non-limiting example of which is SYL-OFF® 9110), a tight release additive (a non-limiting example of which is SYL-OFF® 9151), a crosslinker (a non-limiting example of which is SYL-OFF® 7682-000), and a catalyst (a non-limiting example of which is SYL-OFF® 4000) as summarized in the chart below.

| INGREDIENT | APPROXIMATE WEIGHT PERCENT |
|---|---|
| SYL-OFF ® 9110 | 46 |
| SYL-OFF ® 9151 | 46 |
| SYL-OFF ® 7682-000 | 6 |
| SYL-OFF ® 4000 | 2 |

E. Barrier Agents

In some instances it may be desirable to include a barrier agent with the substrate. The barrier agent may be applied to either the outwardly facing first side of the substrate and/or the inwardly facing second side of the substrate. The barrier agent may be applied to the entire substrate or to portions thereof. It may be applied in a continuous, semi-continuous, or discontinuous pattern, or combinations thereof. It may be applied in discrete locations. The barrier agent may be applied to the substrate in any number of ways including but not limited to spraying, printing, coating, and combinations thereof. In one non-limiting example the barrier agent may be a component of an ink.

The barrier agent may be applied to a carrier non-limiting examples of which include particles such as zeolite, starch, and cyclodextrin; polymeric films; woven or non-woven materials which may be cellulosic or non-cellulosic based; and combinations thereof. The carrier comprising the barrier agent may then be applied to the roller substrate. The barrier agent may also be blended in with the substrate during the substrate manufacturing process. Additionally, the barrier agent can be impregnated into the substrate. The barrier agent may be directly applied to the substrate. It can be applied to the substrate separately from other components or it may be blended and applied with other components.

In one non-limiting embodiment, the carrier comprising the barrier agent may be laminated to the substrate. It may be laminated to discrete locations of the substrate. While not wishing to be bound by theory, in some instances it is possible that contact of the adhesive with the benefit agent on the substrate may reduce the efficacy of the benefit agent. The barrier agent may be used to separate the adhesive and benefit agent so as to help prevent potential reductions in benefit agent efficacy. For instance, in one non-limiting embodiment, where an adhesive is applied to the outwardly facing side of the substrate and a benefit agent such as a perfume is to be applied to the adhesively coated substrate, it may be desirable to apply a barrier agent to all or some part of the areas of the substrate where the adhesive has been applied and to where the perfume is also to be applied so as to minimize contact between the adhesive and the perfume. When used, the barrier agent may be present on the substrate in an amount of about 0.1 grams/$m^2$ to about 15 grams/$m^2$, or about 0.5 grams/$m^2$ to about 5 grams/$m^2$, or about 1 grams/$m^2$ to about 3 grams/$m^2$. Suitable barrier agents include but are not limited to adhesive deadening inks, varnish, shellac, lacquer, polyolefins, paraffins, waxes, polyacrylates, polyurethanes, film forming polymers including but not limited to polyvinyl alcohol, polyvinyl acetate, or combinations thereof. Additionally, thermoplastic and/or thermosetting polymers (including but not limited to polyethylene and polypropylene) may be used alone. These types of polymers would typically be applied in a molten state and allowed to solidify before application of the benefit agent. High opacity/coverage inks such as the inks used to print lottery tickets (i.e.; inks which are typically titanium oxide and/or aluminum oxide based) may also be used. These inks tend to have a "leafing" capacity which provides a compact superficial barrier layer once dried. In addition, polymers that are cured via energy sources such as UV light and/or electron beam may be used. These types of polymers tend to dry quicker than water based chemistries, hence reducing the potential for perfume to migrate into the adhesive while drying. These various types of barrier agents may be used alone or in combination.

One non-limiting example of a suitable barrier agent is an ink commercially available from Environmental Inks and Coatings of Morgaton, N.C. and sold as AQUA SUPER ADHESIVE DEADENER EC0007024. Another suitable barrier agent is sold as AQUAGLOSS LOW SLIP OVERPRINT VARNISH EV0000132 commercially available from Environmental inks and Coatings. Yet another suitable barrier agent is commercially available from Sun Chemical Corporation of Charlotte, N.C. and sold as AQUABAR MVTR COATING PGB00242G1B. Additionally, another suitable barrier agent is commercially available from BASF of Mount Olive, N.J., and is sold as ACRONAL SS04 NLD 528320.

Additionally, catalysts may optionally be used to speed up the setting and adhesion of the barrier agent to the surface of the substrate. This allows for the application of the benefit agent immediately after the barrier agent is applied. It is believed that use of the optional catalyst may also help provide tighter registration on the substrate of the benefit agent to the barrier agent. One suitable catalyst for this purpose is EV001322 Catalyst supplied by Environmental Inks and Coatings of Morgaton, North, Carolina.

F. Optional Additional Components

The present invention may also include one or more other optional additional components, a non-limiting example of which is a signal that communicates the status of the substrate to a user. For example, there may be a signal that indicates when a given portion of the substrate has been fully utilized and hence should be removed from the roll. Non-limiting examples of signals which may be used include indicia, color, olfactory signals, and the like.

One non-limiting example would include providing indicia on the roll wherein the indicia changes color, or disappears, or appears to signal when that portion of the substrate has been fully utilized. In one instance, a color changing signal could be a substrate containing a printed graphic utilizing a white adhesive deadening ink that is practically invisible on the unused substrate as it is of similar color to the unused substrate. One suitable adhesive deadening ink for this purpose is AQUA SUPER ADHESIVE DEADENER EC 0007024 available from Environmental Inks and Coatings. Once the substrate is used and covered with contaminants, the printed graphic will be visible as it will not pick up the contaminants and hence will show up as a whiter area in contrast to the darker contaminant-containing adhesive areas. This may be used as a signal to the user that it is time to remove this substrate wrap from the roller.

In another non-limiting embodiment a signal could be used to indicate to a user when a variable external to the roller has changed such as hot and cold temperature variations, humidity, light, or barometric pressure. One non-limiting example is a thermo chromic ink which changes color at a given activation temperature. One such thermo chromic ink is sold as DYNACOLOR and is available from Chromatic Technologies Incorporated ("CTI") of Colorado Springs, Colo.

In yet another non-limiting example, an encapsulated ink may be used which can rupture under a given usage pressure thereby releasing the inner contents. If desired, the inner content can be colored so as to make a graphic appear in use. Non-limiting examples of inks that may be used for this purpose include inks that are pressure triggered such as those used on pressure sensitive carbonless copy paper. Encapsulated ink suitable for use in the present invention are commercially available from Seiko Epson Corporation of Long Beach, Calif.

The optional additional component may be present on the outwardly facing first side of the substrate and/or the inwardly facing second side of the substrate. When added to the substrate, the additional component is may be present on the substrate in an amount of about 0.1 grams/m$^2$ to about 15 grams/m$^2$, or about 0.5 grams/m$^2$ to about 5 grams/m$^2$, or about 1 grams/m$^2$ to about 3 grams/m$^2$. It may be added to the substrate in any form, non-limiting examples of which include a liquid, powder, solid, and/or foam. The optional additional components may be applied to the substrate in a number of ways familiar to those of ordinary skill in the art including but not limited to spraying, printing, coating, and combinations thereof. The optional additional components may be directly applied to the substrate. They can be applied to the substrate separately from other components or may be blended and applied with other components. The optional additional components may also be blended in with the substrate during the substrate manufacturing process. Additionally, the optional additional components can be impregnated into the substrate. The optional additional components may be applied to the entire substrate or to portions thereof. They may be applied in discrete locations. They may be applied in a continuous, semi-continuous, or discontinuous pattern, or combinations thereof.

Roller Article

In addition to the substrate, benefit agent, and other possible components of the roller described above, the roller article of the present invention may also include a handle. The handle may be constructed of materials familiar to those of ordinary skill in the art. The handle may be integral with the roller or it may be detachable from the roller. The roller article may also include a cover for covering the roller article. The cover may cover all or some portion of the roller article. The cover may be constructed of any material familiar to those of ordinary skill in the art, non-limiting examples of which include cellulosic and non-cellulosic components such as paper, plastics, and the like. All or some portion of the roller article may be disposable. Instructions for use may be included for example on the roller overwrap and/or on the substrate itself.

Method of Making the Roller Article

One non-limiting suitable method of making the roller article of the present invention is described below. The substrate, which may either be blank with no printing or preprinted with graphics/color, is unwound. A liquid release agent is applied to the side of the substrate that is to be facing inwardly on the roller. Non-limiting methods for applying the release coating include printing, coating, and combinations thereof. The release coating is then cured. Non-limiting suitable methods for curing include thermal curing, UV curing, and/or electron beam curing. An adhesive is heated in a tank until it is melted. The adhesive is delivered to a coating head (such as a slot coater, spray coater, kiss coater, or the like) and applied as a thin film onto the outwardly facing side of the substrate. The adhesive may be applied to the substrate in a continuous or discontinuous pattern. The adhesive is then cured on the substrate. The same curing techniques described above may also be used for curing the adhesive. A benefit agent is applied directly on top of the adhesive.

Alternatively, a barrier agent may first be applied on top of the substrate and the benefit agent applied on top of the barrier agent in order to separate the benefit agent from the adhesive. One suitable method for applying the benefit agent and the barrier agent (if used) to the substrate is via a flexographic printing process where the barrier agent is printed first onto the adhesive and then the benefit agent is applied. The benefit agent may be registered with the barrier agent (when used) and/or the adhesive such that the benefit agent is printed onto the substrate in a pattern which overlays the printed pattern of the barrier agent and/or adhesive within a small tolerance of typically about 0.12-0.25 mm. In-line or central impression flexographic presses can be used for this purpose. The printing pattern can be continuous, discontinuous, or a combination thereof.

In one non-limiting embodiment, the barrier agent could be printed in a pattern that minimizes smearing and leaching of the perfume into the adhesive area while the tape is converted in the manufacturing line. In one non-limiting example, the barrier agent is printed in a rectangular shaped pattern with the perfume printed as a smaller square on the shorter length of the barrier agent's rectangular shaped pattern. The contact of the liquid perfume with the stationary or driven rollers in a manufacturing line may cause the perfume to smear off the original printed square pattern and create a wet tail behind. By printing the barrier agent in the area where the wet tail of the perfume is anticipated to occur, it would be possible to inhibit perfume contact with the adhesive even after the perfume is smeared during processing on the manufacturing line.

The printed substrate is slit, perforated, and rewound around a core into a final roll size of typically about 101 mm in width and comprising typically 15-70 wraps. The core, which is typically about 38 mm in diameter, may be preloaded in the rewind equipment (such as a turret rewinder) in approximately 101 mm individual length sizes or may be preloaded in the rewind equipment as a long core log that is cut to size (approximately 101 mm) after the rewinding operation. An outer cover sheet may be applied to protect the first adhesive sheet of substrate from dust and dirt. A handle may be inserted typically into the core either manually or automatically. Additionally, if desired an outer cover, one non-limiting example of which is a plastic hard cover, may be applied to cover the roller article in order to protect the exposed adhesive sheet at any instance in use and/or during storage.

Perfume Composition Embodiments

The following non-limiting perfume composition embodiments are suitable for use with the present invention. The amount of each perfume ingredient for the embodiments is provided in weight %:

| Material | Approx. Boiling Point (° C.) | Embodiment A | Embodiment B | Embodiment C | Embodiment D |
|---|---|---|---|---|---|
| Benzyl Acetate | 215 | — | 2 | — | 1 |
| Benzyl Salicylate | 347 | — | 8 | 20 | 8 |
| Lyral | 320 | — | 8 | 12 | 7 |
| Ligustral | 177 | 5 | 3 | — | 2 |
| Ethyl Vanillin | 286 | — | 2 | — | 2 |
| Citronellol | 225 | 15 | 10 | — | 6 |
| Ethylene Brassylate | 390 | — | 5 | 13 | 9 |
| Dihydro Myrcenol | 208 | 5 | 10 | — | 5 |
| Beta-Ionone | 276 | — | 5 | 10 | 5 |
| Geraniol | 230 | 5 | 12 | — | 6 |
| Methyl 1-napthyl ketone | 310 | — | — | 5 | 3 |
| Linalool | 198 | 30 | 9 | — | 6 |
| Benzyl Benzoate | 314 | — | — | 15 | 10 |
| Cis-3-Hexenyl Acetate | 101 | 5 | 4 | — | 1 |
| Lilial | 258 | 20 | — | — | 5 |
| Hydroxycitronellal | 274 | — | — | 10 | 15 |
| Phenyl Ethyl Alcohol | 220 | — | 15 | — | 3 |
| cis-3-Hexenyl salicylate | 316 | — | 2 | 10 | 5 |
| d-Limonene | 177 | 15 | 5 | — | — |
| Vanillin | 272 | — | — | 5 | 1 |

Roller Embodiments

Non-limiting embodiments of the roller of the present invention are described below.

Embodiment 1

A silicone release agent system comprised of approximately 46% by weight of SYL-OFF® 9110, approximately 46% by weight of SYL-OFF® 9151, approximately 6% by weight SYL-OFF® 7682-000, and approximately 2% by weight of SYL-OFF® 4000 is applied to the inwardly facing side of a polypropylene substrate having a caliper of approximately 0.107 mm, a basis weight of approximately 65 grams/$m^2$ and supplied by Clopay Plastic Products of Cincinnati, Ohio. The release agent is applied to the substrate in an amount of approximately about 1.2 grams/$m^2$ and is then thermally cured at a temperature of approximately about 190° F.-200° F. (88° C.-93° C.). A hot melt adhesive manufactured by H.B. Fuller and sold as HM-1902X is applied at a temperature of approximately about 325° F. (163° C.) by coating the outwardly facing surface of a polypropylene substrate with the adhesive in an amount of about 15 grams of adhesive/$m^2$-25 grams of adhesive/$m^2$ of substrate. The adhesive is allowed to cool. A perfume composition comprised of approximately 35% blooming ingredients and approximately 65% substantive ingredients is applied to the adhesively coated outwardly facing surface of the substrate in 2-5 discrete stripes across the width of each wrap or alternatively 2-5 discrete stripes throughout the length of the roller substrate. Each stripe, which is about 1-3 mm in width, is applied by brush coating or by flexographic printing techniques or by spraying. One suitable sprayer for this purpose is SONOFLUX WIDE TRAK SPRAYER with an ultrasonic nozzle manufactured by Sono-Tek of Milton, N.Y. and a precision syringe pump model No. M361 supplied by Thermo Orion of Beverly, Mass. The concentration of perfume to the total adhesive surface is approximately 1.5-3.0 grams/$m^2$. While not wishing to be bound by theory, it is believed that at this level the tack and other performance attributes of the roller can be maintained while enabling the perfume to transfer from the roller to the fabric surface during use.

Embodiment 2

A polypropylene substrate coated with a hot melt adhesive and a release agent as described in Embodiment 1 is used. In this embodiment, the perfume composition of Embodiment 1 is sprayed onto the entire adhesively coated surface of the substrate. The D90 particle size diameter (i.e.; approximately 90% of the particles have a diameter larger than this value) of the perfume particles dispensed from the nozzle range from about 3 microns to about 200 microns. Atomizing nozzles suitable for this purpose are Part Nos. 1/8JJ+PFJ1050+PAJ73320 (internal mix of benefit agent and air) or Part Nos. 1/8JJ+PFJ1050+PAJ080-65/PAJ07590/PAJ73320 (external mix of perfume and air) available from Spraying Systems Company of Wheaton, Ill. While not wishing to be limited by theory, it is believed that this particle size range helps reduce perfume volatilization. Additionally, if desired, micro crepes may be created on the outwardly facing side of the substrate by web handling methods or by mechanical deformation of the substrate via methods including but not limited to ring rolling, selfing, embossing, and the like. While not wishing to be bound by theory, it is thought that the perfume composition upon application to the substrate will settle into these micro crepes thereby helping to reduce volatilization of the perfume and hence helping enhance perfume longevity.

Embodiment 3

A polypropylene substrate coated with a hot melt adhesive and a release agent as described in Embodiment 1 is used. The perfume composition of Embodiment 1 is applied in discrete stripes each stripe being about 2-4 mm in width and about 100-150 mm in length. Each stripe runs diagonally across the width of the substrate. There are approximately 3-5 stripes per wrap of substrate. The stripe is applied utilizing a flexographic printing process. When flexographically printing a perfume composition onto the substrate, it may be desirable to thicken the perfume composition by pre-mixing with it with a thickener, a non-limiting example of which is 5% ethyl cellulose. While not wishing to be bound by theory, it is believed that by thickening the perfume, more of the perfume will transfer from the printing plate to the substrate thereby enhancing perfume longevity by reducing the perfumes volatility without changing its character and also by allowing for increased add-on of the perfume to the substrate. A suitable flexographic printing press for this purpose is a narrow web Comco flexographic press, measuring 28 cm in width, having 6 stations and capable of hot air drying commercially available from MarkAndy of Milford, Ohio.

Embodiment 4

A polypropylene substrate coated with a hot melt adhesive and a release agent as described in Embodiment 1 is used except that the polypropylene substrate may be a polypropylene substrate having a caliper of about 0.091 mm and a basis weight of about 64 grams/m$^2$ commercially available as EXTREL® 366 supplied by Tredegar. Alternatively, it should be noted, that a substrate which is adhesively coated and treated with a release agent may be used. Such a substrate is available from International Graphic Films Incorporated of Hudson, Ohio. A benefit agent (a non-limiting example of which is a perfume such as the perfume of Embodiment 1) is applied via flexographic printing process to the adhesively coated outwardly facing side of the substrate. In this embodiment the perfume is printed in a defined pattern, a non-limiting example of which is a circular dot pattern, each dot having a diameter of approximately about 1 mm to about 5 mm. The concentration of perfume per dot is approximately about 0.08 mg to about 0.20 mg of perfume depending upon the specific perfume composition and desired level of perfume to be transferred during use. A barrier agent such as an adhesive deadener ink may also be used. The barrier agent is printed on the adhesively coated substrate prior to the perfume composition and is present in approximately the same concentration as the perfume. Alternatively, the barrier agent and perfume could be premixed and applied together to the substrate. The barrier agent and the perfume may be printed in the same pattern as one another. They can both be in registration with one another such that the perfume composition overlays the barrier agent. Hence, the barrier agent in the present example may also be comprised of dots each dot having a diameter of approximately about 1 mm to 5 mm. In addition to a dot pattern, other patterns may be used, non-limiting examples of which include rosettes, halftones, and the like. The barrier agent may be pigmented if desired. Additionally, if desired another layer of barrier agent may be overlayed the first layer of barrier agent. The benefit agent such as a perfume may then be overlayed on top of the last layer of barrier agent. The dots comprising each layer of the barrier agent and/or the benefit agent may vary in size from layer to layer. Additionally, the dots comprising the barrier agent and/or the benefit agent may vary in size within a given layer.

The perfume and deadener can be printed in lighter intensity patterns than dots such as in halftones so as to reproduce the image at a lighter intensity than that of a dot which tends to be 100% solid coverage. Utilizing lighter intensity patterns (less than 100% coverage) will allow for more adhesive to be available in the printed areas of the roller for purposes of picking up lint in the printed areas. It should be noted, that any print pattern may be used. For instance, in one non-limiting example, the barrier agent and/or a benefit agent such as perfume can be printed onto the adhesively coated substrate in the form of indicia including but not limited to letters of the alphabet.

If desired, the barrier agent and/or the benefit agent could be pigmented. The pigment could be of any color. In one non-limiting embodiment, the pigment is of a different shade than that of the adhesively coated surface of the substrate. This can than be printed onto the adhesively coated substrate to provide an aesthetically pleasing appearance. Furthermore, printing the barrier agent and/or benefit agent in a pattern onto the adhesively coated substrate can also be used to serve as a signal to the user of the roller as to when a wrap of the roller substrate needs to be removed. In one non-limiting example, areas of the substrate that are either adhesively coated and include a barrier agent or areas of the substrate that are not adhesively treated will not pick up contaminants while the areas that are adhesively treated will pick up contaminants. The barrier agent can be printed onto the substrate in the form of indicia such as a message that provides a signal to the user as to when to remove the wrap of the substrate. Initially, prior to use, the barrier agent will not be visible. Upon use, the message would become visible in the areas of the substrate where the barrier agent had been applied as these treated areas would have much lower levels of visible contaminants then the untreated adhesively coated areas.

Optionally, a benefit agent such as an anti-static agent may also be applied via flexographic printing onto the adhesively coated outwardly facing side of the substrate in an amount of approximately 0.125 grams/m$^2$. Alternatively, the anti-static agent may be applied by mixing it with the adhesive and applying the mixture to the substrate. When added to the adhesive approximately 0.5% to 2% of the anti-static agent by weight of the adhesive is added. Examples of suitable anti-static agents include but are not limited to quaternary ammonium-based materials. One suitable anti-static agent is commercially sold as STATICIDE Product No. 2001, which is a ready to use anti-static agent for non-porous film surfaces, available from available from ACL Staticide Incorporated of Elk Grove, Ill. When used, the anti-static agent may be applied in registration with the perfume and/or the barrier agent as described above or alternatively, the anti-static agent may be applied directly to the adhesively coated outwardly facing side of the substrate. Alternatively, the anti-static agent may be pre-mixed with one or more benefit agent, a non-limiting example of which is a perfume such as the perfume of Embodiment 1.

Embodiment 5

A barrier agent is printed in a stripe pattern on the outwardly facing adhesively coated surface of a substrate via flexographic printing. A perfume is printed on top of the areas where the barrier agent is applied in a single pass flexographic printing process. Print registration of the perfume composition to the barrier agent is within 0.26 mm. This approach helps reduce potential interactions between the perfume and the adhesive caused by the co-miscibility of the perfume with typical hot melt glues. This approach also expands the range of adhesives that can be used by eliminating contact between the adhesive and the perfume. It should be noted, that the barrier agent and the perfume can be premixed and applied together to the substrate.

The printing plates may be modified to include micro grooves (one non-limiting example of which is to include micro grooves having a depth of at least about 0.127 mm). The micro grooves may be in the form of any pattern, including but not limited to rosettes, dots, and the like. While not wishing to be bound by theory, it is believe that this will allow for the delivery of higher coat weights of the benefit agent to the surface of the substrate. Alternatively, higher coat weights can also be achieved by overprinting for example through the use of multiple print stations on the printing press.

Embodiment 6

This embodiment is the same as Embodiment 5 except instead of a stripe pattern the barrier agent and benefit agent are printed onto the substrate in a dot pattern. The benefit agent is a perfume which is present on the substrate in a concentration of about 0.001 grams of perfume/$cm^2$ of substrate.

Embodiment 7

This embodiment is the same as Embodiment 4 except the benefit agent is an anti-static agent instead of a perfume. The anti-static agent is applied to the substrate in an amount of about 0.1 grams/$m^2$ to about 2 grams/$m^2$.

Embodiment 8

This embodiment is the same as Embodiment 6 except the benefit agent is an anti-static agent instead of perfume.

Embodiment 9

This embodiment is similar to Example 6 with the exception that both perfume and an anti-static agent are printed separately onto separate areas of the adhesively coated substrate. Typically, both the perfume and an anti-static agent are printed onto areas of the adhesively coated substrate that have been treated with a barrier agent. If desired, the perfume and anti-static agent may be premixed and printed together onto areas of the adhesively coated substrate that have been treated with a barrier agent. Alternatively the perfume and anti-static agent can be printed separately one on top of the other.

Embodiment 10

The adhesive is pattern coated on the outwardly facing side of the substrate so as to leave areas of the outwardly facing side wherein the adhesive is not applied. The adhesive may be applied in any type of pattern, non-limiting examples of which include dots, stripes, grids, and the like. The benefit agent such as a perfume is applied in the non-adhesively coated areas of the substrate. A perfume is then applied to the outwardly facing side so as to "flood" the uncoated recess areas. In this way the perfume is contained in recesses of the substrate surface which arise from applying the adhesive in a pattern on the substrate. Alternatively the recesses can be formed by embossing the substrate either prior to or after the application of the adhesive. This helps prevent the perfume from transferring to the inwardly facing side of the next wrap of substrate in the roller. It also helps minimize volatilization of the perfume and contact of the perfume with adhesive while remaining available to transfer to fabric upon contact with the fabric.

Embodiment 11

Like embodiment 10 the perfume is applied in recess areas in a dot pattern (each dot having a diameter of approximately 0.3 mm) to create recessed regions in the substrate with perfume sitting at the bottom. In this embodiment the recess areas are created by pushing the substrate between a hard relieved plate (embossing) and a softer backing roll to create a desired pattern of recessed areas distributed throughout the substrate and having varying depth as intended thereby providing the ability to hold more or less perfume as a function of the pressure/contact point of the substrate with the printing plates. Non-limiting examples of ways this can occur is via the utilization of letterpress printing, and the like.

Embodiment 12

A perfume may be used in conjunction with a foaming barrier agent (a non-limiting example of which is an expanding ink) to soak the perfume (similar to a sponge under pressure) so as to create a more 3-dimensional structure to enhance transfer of the benefit agent and the aesthetics. The perfume is retained by the capillary forces of the foaming barrier agent. The foaming barrier agent acts as a sponge, transferring the perfume to the substrate upon contact/pressure. One suitable example of an expandable foam ink suitable for this purpose is manufactured by Polytex Environmental Inks of Bronx, N.Y.

Embodiment 13

Narrow strips of approximately 1-2 mm in width of a cellulosic or non-cellulosic material (non-limiting examples of which include paper, plastic, foam, co-extruded films, non-wovens, and/or the like) can be coated with a benefit agent including but not limited to a perfume. This material coated with the benefit agent can then be attached (a non-limiting example of which includes attachment by lamination) to the substrate, either in the longitudinal or lateral direction. By using this technique, the benefit agent can be segregated from the adhesive, hence minimizing potential adhesive/benefit agent compatibility concerns.

Embodiment 14

A perfume is premixed with a molten hot melt adhesive and the mixture is applied via slot coater to the outwardly facing side of a polypropylene substrate having a caliper of 0.075 mm and commercially available from Tredegar. The level of perfume in the adhesive to deliver a noticeable perfume transfer is typically about 5%-10%. A silicone release coating available from GE silicones is applied to the inwardly facing side of the substrate.

Embodiment 15

The perfume is encapsulated in soft shells that break when subjected to shear forces like the ones generated by the rolling action of the roller on cloths, or in contact with a trigger chemistry (such as small quantities of water and alcohol) that is released when the substrate wrap is peeled off the roller. The perfume may be encapsulated in starch based capsules or other polymeric materials. It may be applied on to the surface of a substrate (such as the surface of an adhesively treated substrate) via methods such as powder spraying, coating, and/or printing techniques. Alternatively, the perfume can be loaded via both dry and wet high internal phase emulsion ("HIPE") that have the advantage versus microcapsules of being loaded (i.e.; "loaded" or "loading factor" refers to the weight of perfume versus the total microcapsule weight such that in one non-limiting example a 60% loaded microcapsule refers to a microcapsule containing 60% perfume and 40% microcapsule shell material) at a higher rate than the soft shells (i.e.; about 90+% versus about 50%-70%) and is also an easier application method (coating technologies). Suitable microcapsules for this purpose are available from Aveka Incorporated of Woodbury, Minn.

Embodiment 16

The substrate may include a benefit agent such as a perfume that delivers a scent that blossoms over time on the surface of the substrate. One non-limiting means of doing this is to utilize a substrate comprised of co-extruded plastic film. Suitable plastics for this purpose include but are not limited to polypropylene, polyethylene terepthalate, and the like. Prior to extruding, the plastic may be in the form of plastic pellets. The perfume composition can be pre-mixed into the plastic pellets prior to extrusion. If desired, one side of the co-extruded plastic film could include a perfume composition while the other side acts as a barrier to prevent the perfume composition from wicking into the substrate. The perfume scent would then tend to be released over time as the perfume migrates from the bulk of the plastic film to the surface of the substrate. The perfume scent would be transferred from the roller to the fabric upon roller contact with the fabric. If desired, the entire surface could contain the perfume. Alternatively, two or more layers of film could be co-extruded wherein one or more of the layers contains the perfume. Plastic films suitable for this purpose are available from Polyvel Incorporated of Hammonton, N.J.

Embodiment 17

A substrate that has been coated with adhesive on the outwardly facing side and a release agent on the inwardly facing side similar to Embodiment 4 may contain a printed graphic that is printed with the same color ink as the color of the substrate so as to be almost invisible on the unused substrate. Once the adhesive areas of the substrate wrap are covered with contaminants, the printed graphic can signal the end of the usage cycle and the time to discard this substrate wrap by removing from the roller and exposing a new unused wrap of substrate. Additionally, the graphic can be designed to appear and/or disappear when there is a change in temperature, moisture level, and pressure. This can be accomplished by using special coatings and/or inks that change color with changes in temperature, moisture level, and/or pressure. For example, thermo chromic inks can be used which change their color at a given activation temperature. One suitable example of a thermo chromic ink is DYNACOLOR commercially available from CTI of Colorado Springs, Colo. Another suitable ink which may be used for this purpose is an encapsulated ink which can rupture under a given pressure thereby releasing the inner contents of the encapsulate. The inner contents could include a colored pigment such as an ink pigment which would allow for a graphic to appear in use.

In one non-limiting embodiment, a white polypropylene substrate having a caliper of 0.08 mm and basis weight of about 75 grams/$m^2$, sold as EXTREL 393 and commercially available from Tredegar is used. A hot melt adhesive from H.B. Fuller is applied to the outwardly facing side of the substrate. A barrier coating comprised of an adhesive deadener is flexographically printed in a graphic pattern such as a brand logo onto the adhesively treated outwardly facing side of the substrate. A suitable white adhesive for this purpose is a white adhesive deadener commercially available as Aqua Super Adhesive Deadener EC 0007024 manufactured by Environmental Inks and Coatings. Alternatively, a varnish such as AQUAGLOSS LOW SLIP OVERPRINT VARNISH EV0000132 could be used for this purpose. A benefit agent such as a perfume is then applied to the areas of the substrate treated with the adhesive deadener. In use, the areas of the substrate treated with the adhesive deadener will appear white while the untreated adhesively coated areas of the substrate will pick up contaminants and appear to look dark. The white graphic in the areas treated with the adhesive deadener will then be visible against the darker untreated adhesively coated background.

Embodiment 18

In one non-limiting embodiment, the adhesive is applied in discrete zones along the surface of the substrate and the perfume is applied in other areas where there is no adhesive. For example, the perfume could be applied in continuous longitudinal stripes parallel to continuous longitudinal stripes of adhesive wherein there is no adhesive in the striped area where the perfume is being applied. In an alternative example, the adhesive is applied in a pattern and the perfume is registered with the adhesive such that the perfume is applied in the areas where there is no adhesive.

Drawing Description

Referring to FIG. 1, one non-limiting embodiment of a roller article 10 made in accordance with the present invention is shown. Roller article 10 is comprised of handle 30. A roller 20 comprising substrate 40 is attached to handle 30. Substrate 40 is comprised of individual sheets that wrap around roller 20. Substrate 40 may be treated with an adhesive. Typically, substrate 40 is adhesively treated on the outwardly facing side (i.e.; the side of substrate 40 that faces the consumer during use) of substrate 40. Substrate 40 may include benefit agent 50. Benefit agent 50 may be applied to the outwardly facing side of substrate 50 as shown in FIG. 1. Benefit agent 50 may also be applied to the inwardly facing side of substrate 50 (not shown) or to both the outwardly and inwardly facing sides of substrate 50. A release aid may be applied to substrate 40. Typically the release aid is applied to the inwardly facing side of substrate 50. A barrier agent may be applied to substrate 50. Barrier agent may be applied to either or both the outwardly facing side or the inwardly facing side of substrate 50, though typically it will be applied to the same side of a substrate as the adhesive. Other optional components may be applied to substrate 50 as well. Any of these additives to substrate 50 may be applied continuously or discontinuously. The additives may be applied in a pattern if desired. In the non-limiting embodiment of FIG. 1, benefit agent 50 is shown as applied discontinuously in a dot pattern. One or more of the additives may be in registration with one another if desired.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited herein are in relevant part, incorporated by reference. The citation of any document is not to be construed as an admission that it is prior art with respect to the present invention.

What is claimed is:

1. A hand-held roller for providing benefits to fabrics, said hand-held roller comprising:

a) a substrate formed into a roll, said substrate including a first side and a second side opposite said first side;

b) an adhesive on said first side of said substrate;

c) a barrier agent on said first side of said substrate wherein said barrier agent is flexographically applied to said first side of said substrate in discrete locations;

d) a benefit agent wherein said benefit agent is flexographically applied to said barrier agent on said first side of said substrate; and e) an optional release coating on said second side of said substrate wherein said first side of said substrate is facing outwardly and said second side of said substrate faces inwardly toward the center of said roll.

2. The hand-held roller of claim 1 wherein said benefit agent is encapsulated.

3. The hand-held roller of claim 1 further comprising a signal that communicates the status of said substrate to a user.

4. A hand-held roller for providing benefits to fabrics, said hand-held roller comprising:

a) a substrate formed into a roll, said substrate having a first side and a second side opposite said first side;

b) an adhesive on said first side of said substrate; and c) a benefit agent on said first side of said substrate said benefit agent present on said substrate in an amount of about 0.1 gram/$m^2$ to about 15 grams/$m^2$ wherein said benefit agent comprises a perfume composition, said perfume composition comprising at least about 25% by weight of blooming perfume ingredients and at least about 25% by weight of substantive perfume ingredients; said benefit agent being separated from said adhesive.

5. The hand-held roller of claim 4 further comprising a barrier agent wherein the benefit agent is separated from said adhesive by said barrier agent.

6. The hand-held roller of claim 4 wherein each of said benefit agent and said adhesive each form discontinuous patterns on said substrate.

7. The hand-held roller of claim 6 wherein the discontinuous pattern of said benefit agent and/or said adhesive is in the form of a dot, a stripe, or a combination thereof.

8. A hand-held roller for providing benefits to fabrics, said hand-held roller comprising:

a) a substrate formed into a roll, said substrate having a first side and a second side opposite said first side;

b) an adhesive on said first side of said substrate; and c) a benefit agent on said first side of said substrate said benefit agent present on said substrate in an amount of about 0.1 gram/$m^2$ to about 15 grams/$m^2$ wherein said benefit agent comprises a perfume composition, said perfume composition comprising at least about 25% by weight of blooming perfume ingredients and at least about 25% by weight of substantive perfume ingredients, said hand-held roller further comprising a barrier agent wherein said benefit agent is applied to said barrier agent such that said benefit agent overlays said barrier agent.

9. The hand-held roller of claim 8 wherein said benefit agent does not contact said adhesive.

* * * * *